US008646865B2

(12) United States Patent
Yoshida

(10) Patent No.: US 8,646,865 B2
(45) Date of Patent: Feb. 11, 2014

(54) PRINTING APPARATUS, AND COMPUTER READABLE STORAGE MEDIA FOR STORING PRINTING INSTRUCTIONS

(75) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 177 days.

(21) Appl. No.: 13/424,007

(22) Filed: Mar. 19, 2012

(65) Prior Publication Data

US 2012/0249650 A1 Oct. 4, 2012

(30) Foreign Application Priority Data

Mar. 30, 2011 (JP) ..... 2011-076555

(51) Int. Cl.
*B41J 29/38* (2006.01)

(52) U.S. Cl.
USPC ..... 347/16; 347/19; 347/104

(58) Field of Classification Search
USPC ..... 347/14, 16, 19, 101, 104, 105
See application file for complete search history.

(56) References Cited

U.S. PATENT DOCUMENTS 7,762,659 B2 * 7/2010 Nishizaka ..... 347/104
2008/0252948 A1 10/2008 Onishi

FOREIGN PATENT DOCUMENTS

JP 2002-103757 A 4/2002
JP 2002-192815 A 7/2002
JP 2007-152872 A 6/2007
JP 2008-281549 A 11/2008

* cited by examiner

*Primary Examiner* — Juanita D Jackson
(74) *Attorney, Agent, or Firm* — Baker Botts L.L.P.

(57) ABSTRACT

A printing apparatus includes a printing unit printing an image on a print sheet with a print agent; a discharging unit; a conveying unit including a conveying path; a measuring unit provided on the conveying path of the conveying unit to measure each colored area formed by the printing unit that deposits the print agent on the print sheet from at least one of a first face and a second face; and a conveyance control unit performing a first conveying process in which the colored area passes through a measurement point after a certain time from the formation of the colored area in the measurement of the colored area and a second conveying process in which the colored area passes through the measurement point before the certain time from the formation of the colored area in non-measurement of the colored area.

13 Claims, 14 Drawing Sheets

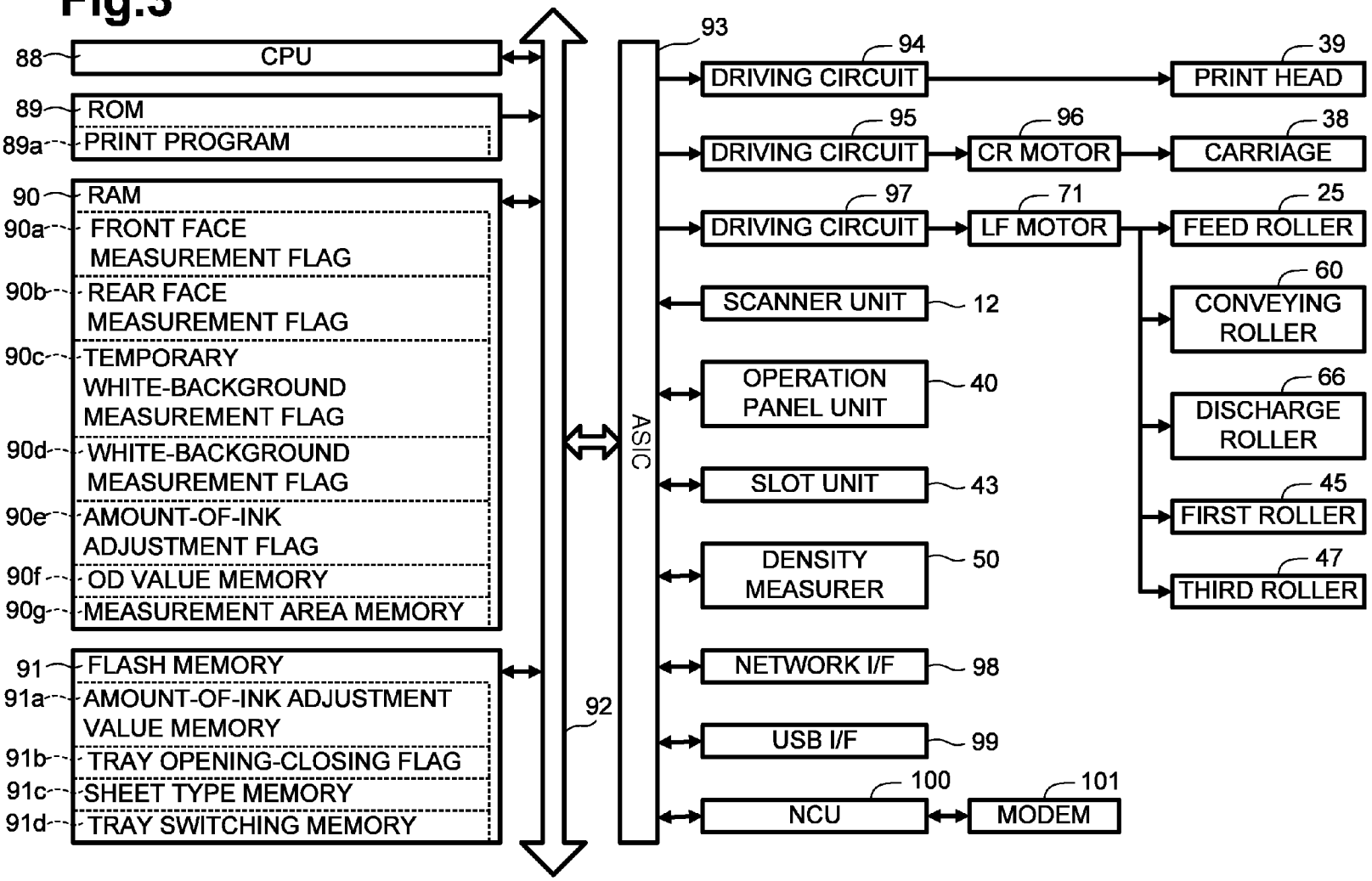
Fig.3
CPU
88
ROM
89
PRINT PROGRAM
89a
RAM
90
FRONT FACE MEASUREMENT FLAG
90a
REAR FACE MEASUREMENT FLAG
90b
TEMPORARY WHITE-BACKGROUND MEASUREMENT FLAG
90c
WHITE-BACKGROUND MEASUREMENT FLAG
90d
AMOUNT-OF-INK ADJUSTMENT FLAG
90e
OD VALUE MEMORY
90f
MEASUREMENT AREA MEMORY
90g
FLASH MEMORY
91
AMOUNT-OF-INK ADJUSTMENT VALUE MEMORY
91a
TRAY OPENING-CLOSING FLAG
91b
SHEET TYPE MEMORY
91c
TRAY SWITCHING MEMORY
91d
92
ASIC
93
DRIVING CIRCUIT
94
DRIVING CIRCUIT
95
DRIVING CIRCUIT
97
SCANNER UNIT
12
OPERATION PANEL UNIT
40
SLOT UNIT
43
DENSITY MEASURER
50
NETWORK I/F
98
USB I/F
99
NCU
100
MODEM
101
PRINT HEAD
39
CARRIAGE
38
FEED ROLLER
25
CONVEYING ROLLER
60
DISCHARGE ROLLER
66
FIRST ROLLER
45
THIRD ROLLER
47
CR MOTOR
96
LF MOTOR
71

REAR FACE

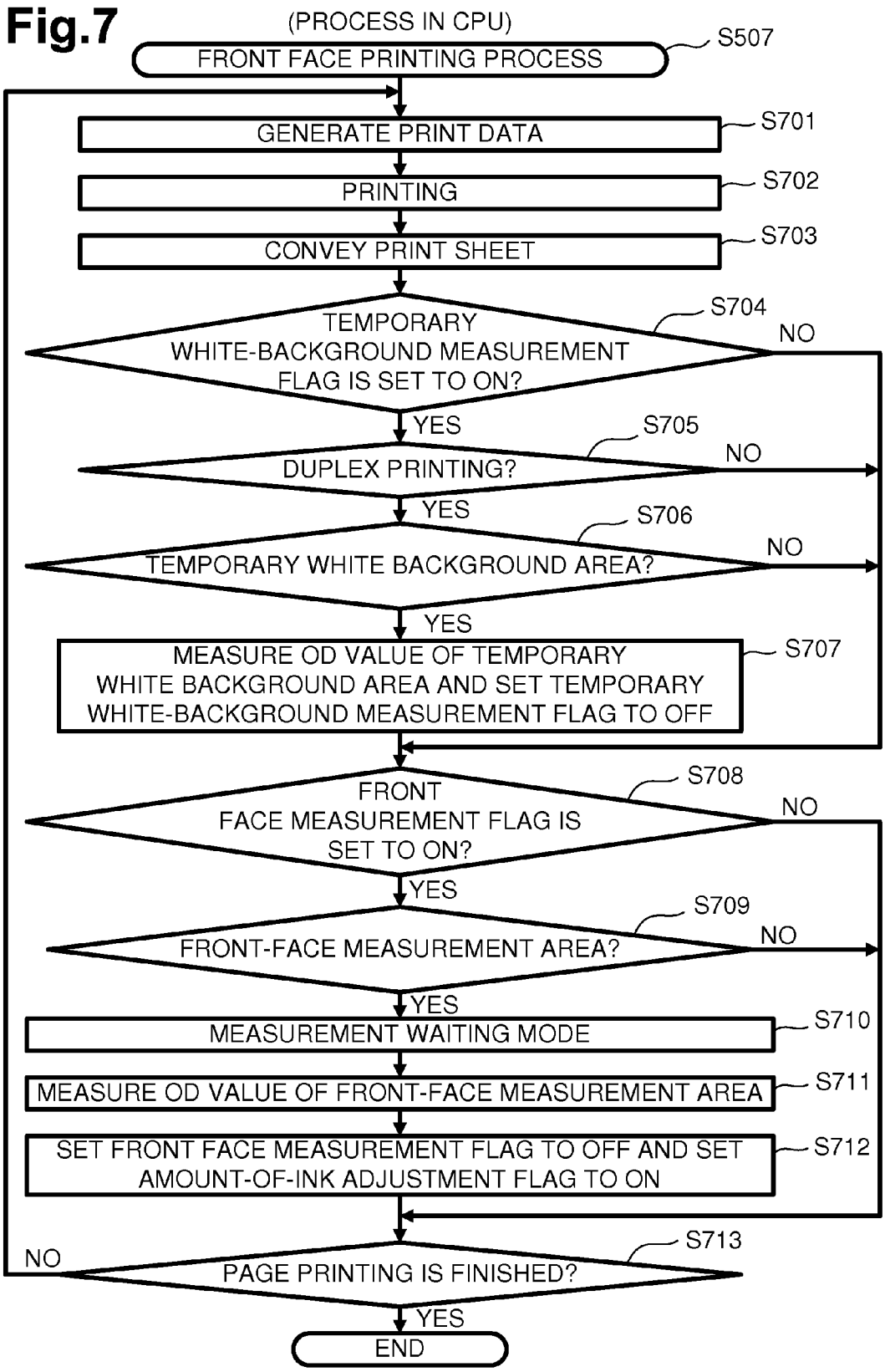
Fig.7
(PROCESS IN CPU)
FRONT FACE PRINTING PROCESS
S507
GENERATE PRINT DATA
S701
PRINTING
S702
CONVEY PRINT SHEET
S703
TEMPORARY WHITE-BACKGROUND MEASUREMENT FLAG IS SET TO ON?
S704
NO
YES
DUPLEX PRINTING?
S705
NO
YES
TEMPORARY WHITE BACKGROUND AREA?
S706
NO
YES
MEASURE OD VALUE OF TEMPORARY WHITE BACKGROUND AREA AND SET TEMPORARY WHITE-BACKGROUND MEASUREMENT FLAG TO OFF
S707
FRONT FACE MEASUREMENT FLAG IS SET TO ON?
S708
NO
YES
FRONT-FACE MEASUREMENT AREA?
S709
NO
YES
MEASUREMENT WAITING MODE
S710
MEASURE OD VALUE OF FRONT-FACE MEASUREMENT AREA
S711
SET FRONT FACE MEASUREMENT FLAG TO OFF AND SET AMOUNT-OF-INK ADJUSTMENT FLAG TO ON
S712
NO
PAGE PRINTING IS FINISHED?
S713
YES
END

PRINTING APPARATUS, AND COMPUTER READABLE STORAGE MEDIA FOR STORING PRINTING INSTRUCTIONS

CROSS-REFERENCE TO RELATED APPLICATION

This application claims priority from Japanese Patent Application No. 2011-076555, filed on Mar. 30, 2011, which is incorporated herein by reference.

BACKGROUND OF THE INVENTION

1. Field of the Invention

The present invention relates generally to printing apparatus, methods for implementing image printing, and computer readable media for storing printing instructions.

2. Description of Related Art

When performing known methods and apparatus for printing test patterns, the print densities of the print results are measured with print density sensors, and print conditions are calculated from the measurement results. The printing is subsequently performed under the calculated print conditions.

Nevertheless, in known methods and apparatus for printing test patterns, when the print densities are measured immediately after the printing, the measurement may be performed before print agents sufficiently stick onto the sheets of paper and the print densities are not accurately measured.

SUMMARY OF THE INVENTION

The present invention may provide printing apparatus configured to measure and methods for measuring the print states of colored areas formed by addition of a print agent accurately.

According to an embodiment of the present invention, a printing apparatus comprising: a printing unit configured to form an image on a predetermined surface of a print sheet by depositing a print agent on the print sheet; a discharging unit configured to receive the print sheet; a conveying unit configured to convey the print sheet from the printing unit to the discharging unit through a conveying path; a measuring unit disposed along the conveying path and configured to measure a print characteristic of the image formed by the printing unit on the print sheet; a conveyance control unit configured to control the conveying unit to perform a first conveying process, in which the conveying unit conveys the print sheet, such that a colored area of the image formed on the print sheet passes through a measurement point in the conveying path, where the measuring unit measures the print characteristic of the image, after a predetermined time has elapsed since the printing unit forms the colored area of the image on the print sheet, and a second conveying process, in which the conveying unit conveys the print sheet, such that the colored area of the image formed on the print sheet passes through the measurement point in the conveying path before the predetermined time has elapsed since the printing unit forms the colored area of the image on the print sheet, wherein the conveyance control unit is configured to control the conveying unit to perform the first conveying process when the colored area of the image is measured by the measuring unit and to control the conveying unit to perform the second conveying process when the colored area of the image is not measured by the measuring unit.

According to another embodiment of the present invention, a printing apparatus comprising: a controller configured to control the printing apparatus to execute steps of: forming an image on a print sheet by depositing a print agent on the print sheet; receiving the print sheet at a discharging unit; conveying the print sheet to the discharging unit through a conveying path; and measuring a print characteristic of the image formed on the print sheet; selectively conveying the print sheet in a first conveying process, in which the print sheet is conveyed, such that a colored area of the image formed on the print sheet passes through a measurement point in the conveying path, where the print characteristic of the image is measured, after a predetermined time has elapsed since the colored area of the image is formed on the print sheet, and in a second conveying process, in which the print sheet is conveyed, such that the colored area of the image formed on the print sheet passes through the measurement point in the conveying path before the predetermined time has elapsed since the colored area of the image is formed on the print sheet, wherein the print sheet is conveyed in the first conveying process when the print characteristic is measured from the colored area of the image and the print sheet is conveyed in the second conveying process when the print characteristic is not measured from the colored area of the image.

According to yet another embodiment of the present invention, a non-transitory computer readable storage medium storing computer readable instructions that, when executed, cause a printing apparatus to execute steps of: forming an image on a print sheet by depositing a print agent on the print sheet; receiving the print sheet at a discharging unit; conveying the print sheet to the discharging unit through a conveying path; and measuring a print characteristic of the image formed on the print sheet; selectively conveying the print sheet in a first conveying process, in which the print sheet is conveyed, such that a colored area of the image formed on the print sheet passes through a measurement point in the conveying path, where the print characteristic of the image is measured, after a predetermined time has elapsed since the colored area of the image is formed on the print sheet, and in a second conveying process, in which the print sheet is conveyed, such that the colored area of the image formed on the print sheet passes through the measurement point in the conveying path before the predetermined time has elapsed since the colored area of the image is formed on the print sheet, wherein the print sheet is conveyed in the first conveying process when the print characteristic is measured from the colored area of the image and the print sheet is conveyed in the second conveying process when the print characteristic is not measured from the colored area of the image.

According to still another embodiment of the present invention, a method for implementing image printing comprising steps of: forming an image on a print sheet by depositing a print agent on the print sheet; receiving the print sheet at a discharging unit; conveying the print sheet to the discharging unit through a conveying path; and measuring a print characteristic of the image formed on the print sheet; selectively conveying the print sheet in a first conveying process, in which the print sheet is conveyed, such that a colored area of the image formed on the print sheet passes through a measurement point in the conveying path, where the print characteristic of the image is measured, after a predetermined time has elapsed since the colored area of the image is formed on the print sheet, and in a second conveying process, in which the print sheet is conveyed, such that the colored area of the image formed on the print sheet passes through the measurement point in the conveying path before the predetermined time has elapsed since the colored area of the image is formed on the print sheet, wherein the print sheet is conveyed in the first conveying process when the print characteristic is measured from the colored area of the image and the print sheet is conveyed in the second conveying process when the print characteristic is not measured from the colored area of the image.

The present invention may be implemented in various modes including print control apparatus, printing apparatus including print control apparatus, print control methods, and a computer readable storage media on which a computer program for controlling print control apparatus is stored.

According to printing apparatus of the present invention, the print agent may sufficiently stick onto a print sheet, because the print sheet may be conveyed in the first conveying process when the colored area is measured by the measuring unit. Accordingly, the print state of the colored area may be accurately measured.

Other objects, features, and advantages of an embodiment of the invention will be apparent to persons of ordinary skill in the art from the following description of an embodiment with reference to the accompanying drawings.

BRIEF DESCRIPTION OF THE DRAWINGS

For a more complete understanding of the present invention, needs satisfied thereby, and the objects features, and advantages thereof, reference now is made to the following descriptions taken in connection with the accompanying drawings.

FIG. 3 is a schematic diagram depicting an electrical configuration of a multifunction machine according to an embodiment of the present invention.

FIG. 7 is a flow chart depicting a front face printing process according to an embodiment of the present invention.

DESCRIPTION OF EMBODIMENTS OF THE INVENTION

Structure of Multifunction Machine 10

Figure 1:
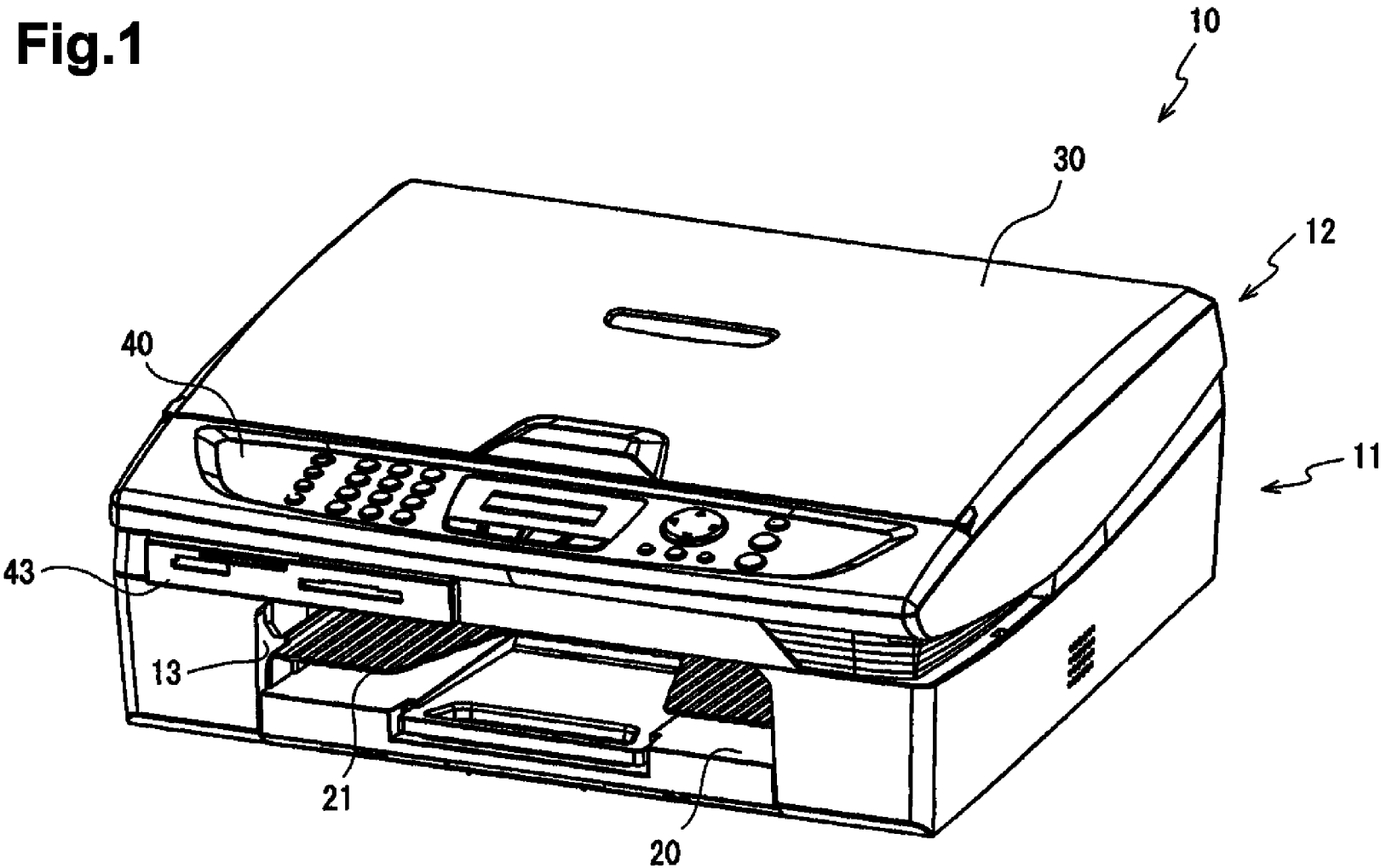
FIG. 1 is a perspective view of a multifunction machine according to an embodiment of the present invention.

Embodiments of the invention now are described in detail with reference to the accompanying drawings; like reference numerals are used for corresponding parts in the various drawings.

Referring to FIG. 1, a multifunction machine 10, e.g., a printing apparatus, may have various functions including one or more of a copy function, a facsimile function, a scanner function, and a printer function. In particular, the multifunction machine 10 may accurately measure the density of a colored area formed by addition, e.g., deposit, of a print agent. The multifunction machine 10 may include a printer unit 11 in a lower portion, a scanner unit 12 in an upper portion, an operation panel unit 40 in a front upper portion, and a slot unit 43 in a front portion.

The printer unit 11 may have an opening 13 formed through the front side thereof. The printer unit 11 may include a paper feeding tray 20 provided at a lower level and a paper output tray 21 provided at an upper level. The paper feeding tray 20 and the paper output tray 21 may be provided, such that part of the paper feeding tray 20 and part of the paper output tray 21 may be externally exposed from the opening 13. Each print sheet loaded in the paper feeding tray 20 may be fed to the inner part of the printer unit 11 where an image may be formed on the print sheet, and the print sheet may be discharged from the printer unit 11 into the paper output tray 21. The paper feeding tray 20 may include a removable slide tray. Another print sheet, e.g., a postcard, an envelope, or the like, which is different from the print sheets loaded in the paper feeding tray 20, may be fed from the slide tray. The scanner unit 12 may be a flat bed scanner. A document cover 30 may be disposed as a top panel of the multifunction machine 10 and may have a platen glass arranged thereunder. An original document placed on the platen glass may be scanned by the scanner unit 12, when the original document is covered with the document cover 30.

The operation panel unit 40 may receive user instructions to operate the printer unit 11 and the scanner unit 12 and may include various buttons and display, e.g., a liquid crystal display. A user may operate the operation panel unit 40 to set and perform various functions. For example, the user may set the type of a print sheet, e.g., a plain or non-glossy sheet, a glossy sheet, a cardboard, a postcard, or the like; for single-sided or duplex printing; and the resolution using the operation panel unit 40. The slot unit 43 may be configured to receive various compact memory cards, e.g., storage media. For example, image data stored in the compact memory card may be read out, and the read out image data may be printed on a print sheet in response to a user's operation of the operation panel unit 40, when a compact memory card is loaded in the slot unit 43.

Structure of Printer Unit 11

Figure 2:
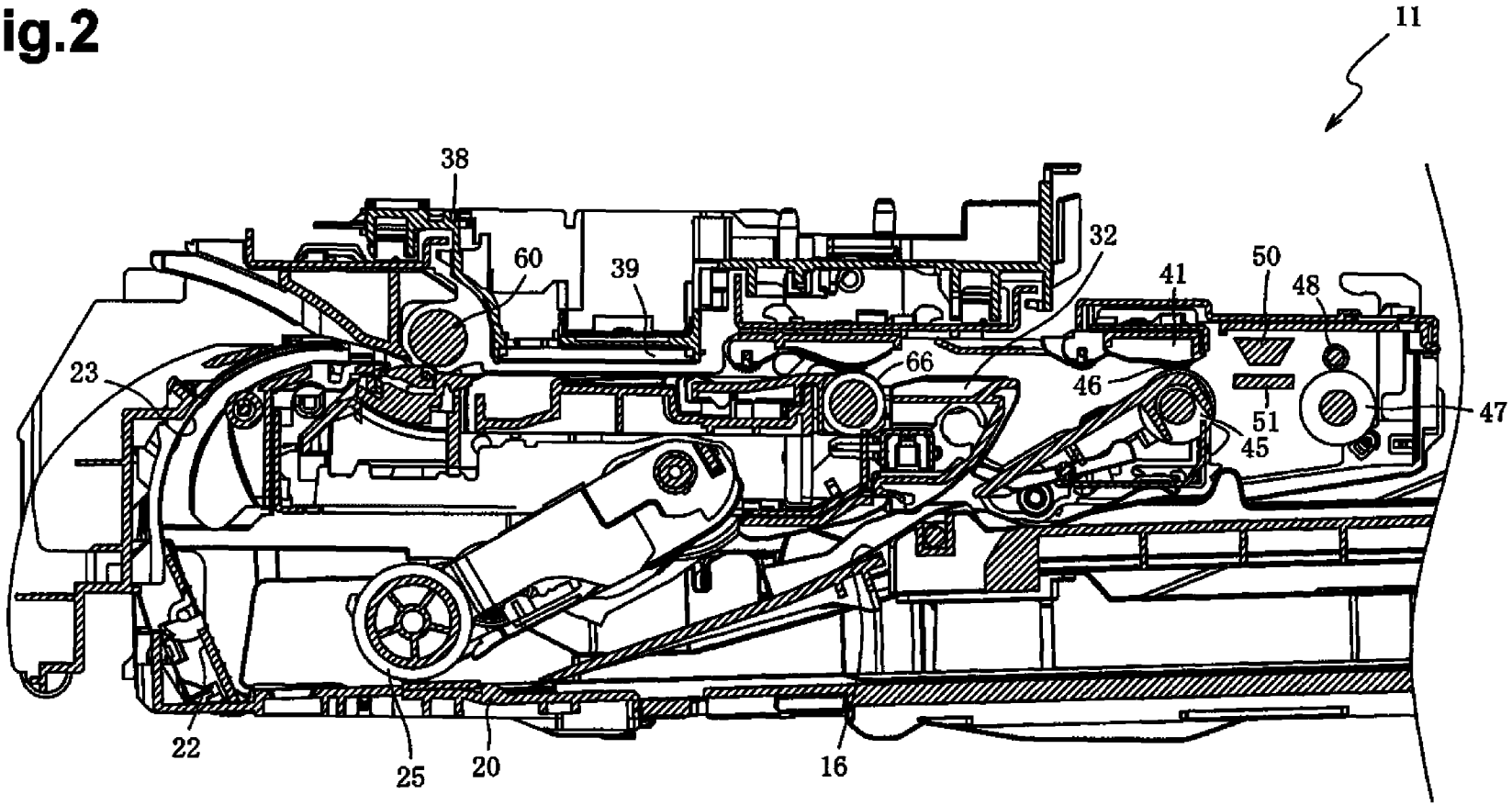
FIG. 2 is a partial, cross-sectional view of a printing unit in a multifunction machine according to an embodiment of the present invention.

Referring to FIG. 2, the printer unit 11 may include the paper feeding tray 20; a feed roller 25; a separation inclined wall 22; a U-shaped conveying path 23; a conveying roller 60; a print head 39, e.g., a printing unit, installed on a carriage 38; a discharge roller 66; a pair of a first roller 45 and a second roller 46; and a pair of a third roller 47 and a fourth roller 48, e.g., conveying unit. In a single-sided printing mode, a print sheet loaded in the paper feeding tray 20 may be fed by the feed roller 25 along the separation inclined wall 22 and the conveying path 23 and is conveyed to a position opposing the print head 39 by the conveying roller 60. Then, after an image is printed on the print sheet with ink, e.g., the print agent, discharged from the print head 39, the print sheet then may be discharged into the paper output tray 21 by the discharge roller 66, the first roller 45 and the second roller 46, and the third roller 47 and the fourth roller 48.

The printer unit 11 may include a sheet guide face 32, a path switching arm 41, and a reverse path 16. The sheet guide face 32 may extend toward a downstream side from the discharge roller 66. The path switching arm 41 may extend toward an upstream side while supporting the second roller 46 at one side thereof and may be rotatable about the first roller 45. The reverse path 16 may extend toward the feed roller 25 from the other end of the path switching arm 41.

In the duplex printing mode, the printer unit 11 temporarily may stop the print sheet having an image printed by the print head 39 on a front face thereof, when the downstream end side of the print sheet is sandwiched between the first roller 45 and the second roller 46 and between the third roller 47 and the fourth roller 48, and the upstream end side of the print sheet passes through the discharge roller 66 and is supported on the sheet guide face 32. The printer unit 11 then may rotate the path switching arm 41 counterclockwise around the first roller 45 from the state shown in FIG. 2, to press the upstream end side of the stopped print sheet downward with the path switching arm 41, and may cause the upstream end of the print sheet supported by the sheet guide face 32 to enter the reverse path 16. The printer unit 11 then may cause the first roller 45 and the third roller 47 to rotate counterclockwise to convey the print sheet to the feed roller 25 along the reverse path 16. The front face on which the image is printed may abut the feed roller 25. The print sheet then may be conveyed to the print head 39, where an image is printed on a rear face of the print sheet, and the print sheet may be discharged into the paper output tray 21.

The printer unit 11 may include a density measurer 50, e.g., measuring unit, and a measurement plate 51 at a position between the pair of the first roller 45 and the second roller 46 and between the pair of the third roller 47 and the fourth roller 48. The density measurer 50 may be arranged at the side of a print face where the print sheet is subjected to printing by the print head 39. The density measurer 50 may measure an optical reflection density ("OD value") of a colored area formed on the print sheet with the ink discharged from the print head 39. The density measurer 50 may include a light emitting element array having multiple light emitting elements arranged therein and a light receiving element array having multiple light receiving elements arranged therein. The light emitting element array may be positioned opposite from the light receiving element array. The light emitting element array and the light receiving element array may be arranged along a main scanning direction, e.g., a direction orthogonal to the direction in which the print sheet is conveyed. A measurement target may be irradiated with light emitted from the light emitting elements. The reflected light may be received by the light receiving elements. The reflected light may be converted into red-green-blue ("RGB") value to measure the density of the measurement target from the RGB value.

A measurable size and a measurable density may be set in the density measurer 50. A measurable size and a measurable density respectively may be a size and a density of a target which may accurately be measured. If the size of the measurement target is less than the measurable size or if the density of the measurement garget is less than the measurable density, the measurement target may not be accurately measured. For example, if the average of the RBG, used as the measured density, is greater than or equal to a certain value, and the measured density is low when the measured size is less than six millimeters square, the density and size may not be accurately measured. Thus, a dark colored area having a size greater than the sizes measurable by the density measurer 50 and having a density greater than the densities measurable by the density measurer 50 may be identified as the measurement target. In other words, when the colored area having a size greater than the sizes measurable by the density measurer 50 and having a density greater than the densities measurable by the density measurer 50 is identified as the measurement target, it is possible to achieve accurate measurement.

The measurement plate 51 may be arranged to face the density measurer 50 and may be a white or black plate. The measurement plate 51 may support the print sheet at a side of the print sheet opposite from the density measurer 50 side. The measurement plate 51 may measure the colored area as the measurement target when the stopped print sheet is sandwiched between the density measurer 50 and the measurement plate 51. During the measurement process, the density measurer 50 and the measurement plate 51 may reciprocate in the main scanning direction by means of a ball screw mechanism and may implement the measurement at an arbitrary position in the main scanning direction. The density measurer 50 and the measurement plate 51 may move away from the conveying path of the print sheet when the measurement process is finished. A lift mechanism may move the ball screw mechanism upward and downward, such that the density measurer 50 moves upward away from the conveying path and the measurement plate 51 moves downward away from the conveying path.

The distance between the pair of the first roller 45 and the second roller 46 and the pair of the third roller 47 and the fourth roller 48 may be less than the length of the print sheet conveyed in the conveying direction. Accordingly, the measurement by the density measurer 50 may be performed in a stable state in which the upstream side of the print sheet is sandwiched between the first roller 45 and the second roller 46, and the downstream side of the print sheet is sandwiched between the third roller 47 and the fourth roller 48. Because the pair of the third roller 47 and the fourth roller 48 is arranged at a position where the density measurer 50 is sandwiched between the pair of the third roller 47 and the fourth roller 48 and the pair of the first roller 45 and the second roller 46, the pair of the third roller 47 and the fourth roller 48 and the pair of the first roller 45 and the second roller 46 may the density measurer 50 from ambient light, such that accurate measurement may be achieved.

Internal Configuration of Multifunction Machine 10

Referring to FIG. 3, the multifunction machine 10 may include a central processing unit (CPU) 88, a read only memory (ROM) 89, a random access memory (RAM) 90, and a flash memory 91. These components may be connected to an Application Specific Integrated Circuit (ASIC) 93 via a bus 92.

Figure 5:
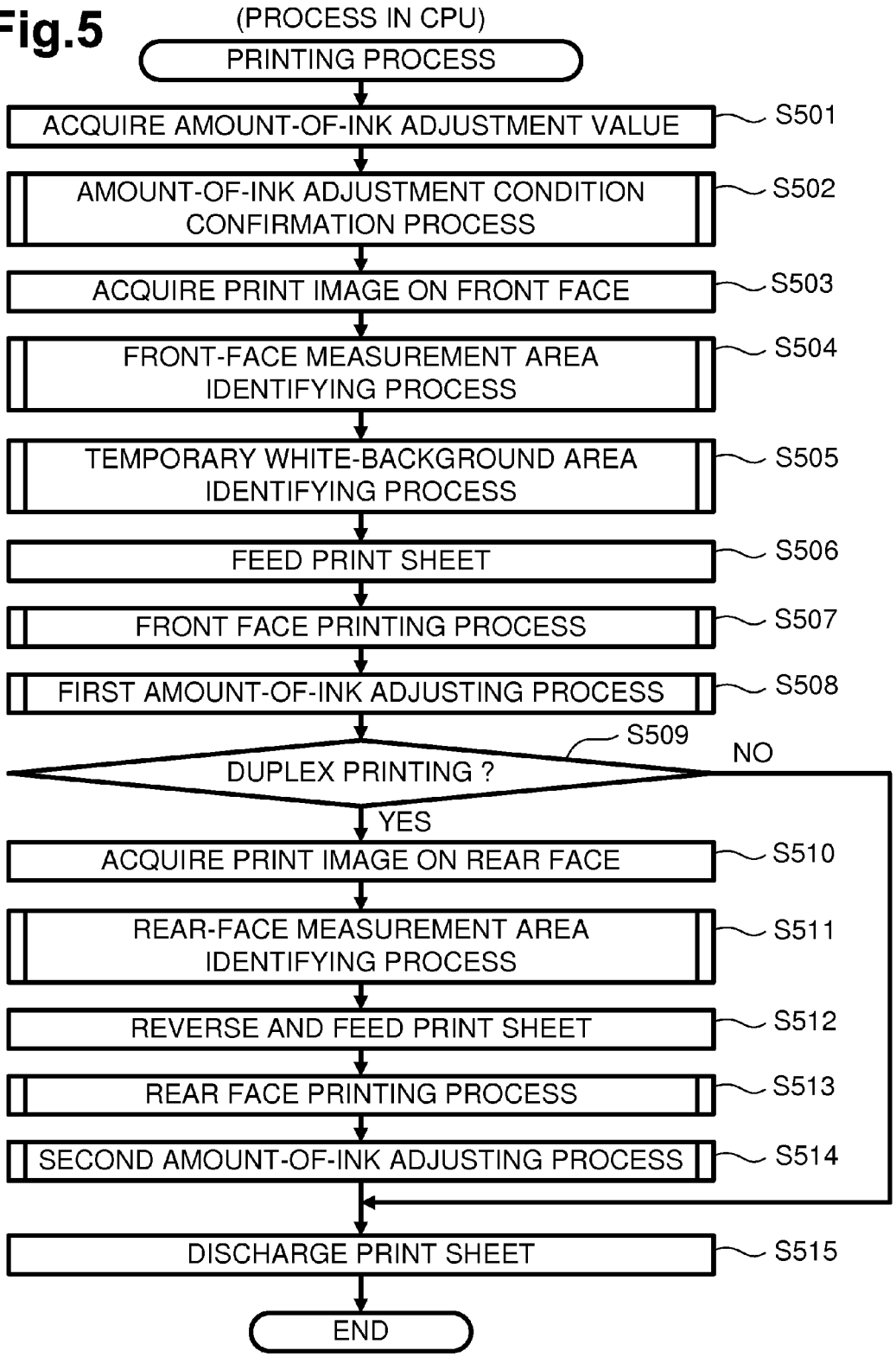
FIG. 5 is a flow chart depicting a printing process according to an embodiment of the present invention.

The CPU 88 may control various functions of the multifunction machine in accordance with values and programs stored in the ROM 89 or the flash memory 91, data stored in the RAM 90, or various signals transmitted and received via a network interface (I/F) 98, a universal serial bus (USB) interface (I/F) 99, or a network control unit (NCU) 100. The ROM 89 may be a non-rewritable memory storing a print program 89*a*. The CPU 88 may perform a printing process, as shown in FIG. 5, in accordance with the print program 89*a*. The RAM 90 may be a rewritable volatile memory. A front face measurement flag 90*a*, a rear face measurement flag 90*b*, a temporary white-background measurement flag 90*c*, a white-background measurement flag 90*d*, an amount-of-ink adjustment flag 90*e*, an OD value memory 90*f*, and a measurement area memory 90*g* may be provided by or within the RAM 90.

The front face measurement flag 90*a* may indicate whether the OD value of the colored area formed on the front face is to be measured from the front face where the printing is first performed. The rear face measurement flag 90*b* may indicate whether the OD value of the colored area formed on the front face is to be measured from the rear face opposite to the front face. The temporary white-background measurement flag 90*c* may indicate whether the OD value of a background of the front face is to be measured from the front face. The white-background measurement flag 90*d* may indicate whether the OD value of a background of the rear face is to be measured from the rear face. The amount-of-ink adjustment flag 90*e* may indicate whether the amount of ink is to be adjusted. The OD value memory 90*f* may store the OD value that has been measured. The measurement area memory 90*g* may store a measurement area, e.g., a position of the measurement area where the OD value is measured.

The flash memory 91 may be a rewritable non-volatile memory. An amount-of-ink adjustment value memory 91*a*, a tray opening-closing flag 91*b*, a sheet type memory 91*c*, and a tray switching memory 91*d* may be provided in the flash memory 91. An amount-of-ink adjustment value may be stored in the amount-of-ink adjustment value memory 91*a*. The amount-of-ink adjustment value may be a correction value for adjusting the amount of ink calculated from the measurement result of the OD value. The amount of ink for printing may be corrected in accordance with the amount-of-ink adjustment value stored in the amount-of-ink adjustment value memory 91*a* to implement printing at an accurate density. The tray opening-closing flag 91*b* may indicate whether the paper feeding tray 20 is removed or installed during a period between printing operations. The CPU 88 may set the tray opening-closing flag 91*b* to ON if the paper feeding tray 20 is removed for loading paper and may set the tray opening-closing flag 91*b* to OFF if the instructed printing is finished. The sheet type memory 91*c* may store the type of the print sheet used in the last instructed printing. The tray switching memory 91 d may store the tray used in the last instructed printing.

Driving circuits 94, 95, and 97, the scanner unit 12, the operation panel unit 40, the slot unit 43, the density measurer 50, the network I/F 98, the USB I/F 99, and the NCU 100 may be connected to the ASIC 93. The ASIC 93 may be connected to the CPU 88 via the bus 92.

The driving circuit 94 may be connected to the print head 39 and may control the print head 39 to selectively discharge the ink on the print sheet at certain timing. The driving circuit 94 may drive and control the print head 39 in response to an output signal generated in the ASIC 93 based on a driving control process output from the CPU 88. The driving circuit 95 may drive a carriage (CR) motor 96 connected to the carriage 38 and may generate an electrical signal for driving the CR motor 96 in response to an output signal from the ASIC 93. The driving circuit 97 may drive a line feed (LF) motor 71 connected to the feed roller 25, the conveying roller 60, the discharge roller 66, the first roller 45, and the third roller 47 and may generate an electrical signal for driving the LF motor 71 in response to an output signal from the ASIC 93.

The network I/F 98 may connect the multifunction machine 10 to a wide area network, e.g., the Internet, or a local area network (LAN) line. The USB I/F 99 may connect the multifunction machine 10 to a USB device. The NCU 100 may be connected to a modem 101 and may control a telephone line. The modem 101 may modulate a transmission signal into a mode appropriate for the transmission through the telephone line in facsimile transmission and may demodulate a modulation signal sent through the telephone line in facsimile reception.

Description of Measurement Area

Figure 4A:
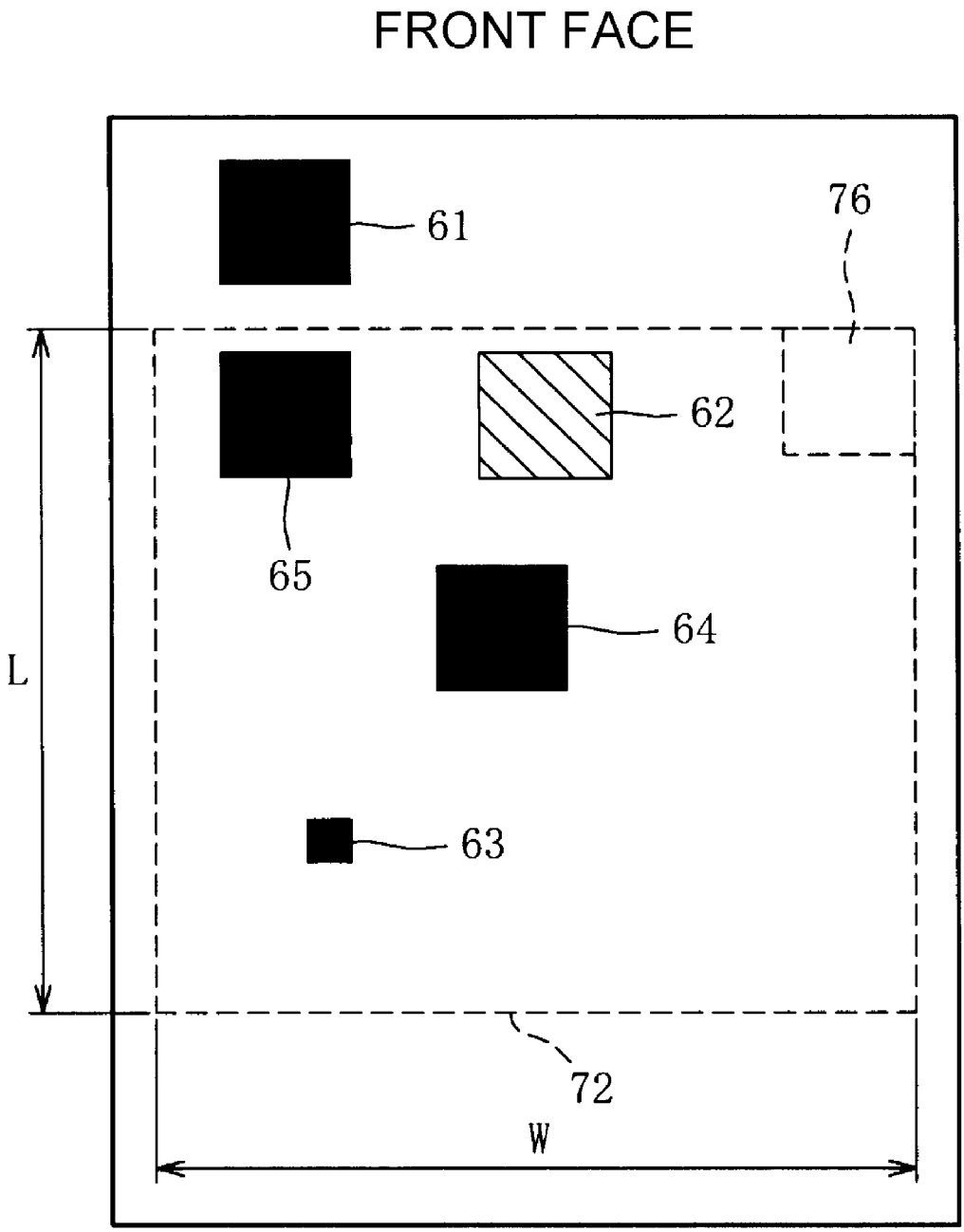
FIG. 4A is a diagram depicting measurement targets for which optical reflection densities ("OD") values are measured according to an embodiment of the present invention.
Figure 4B:
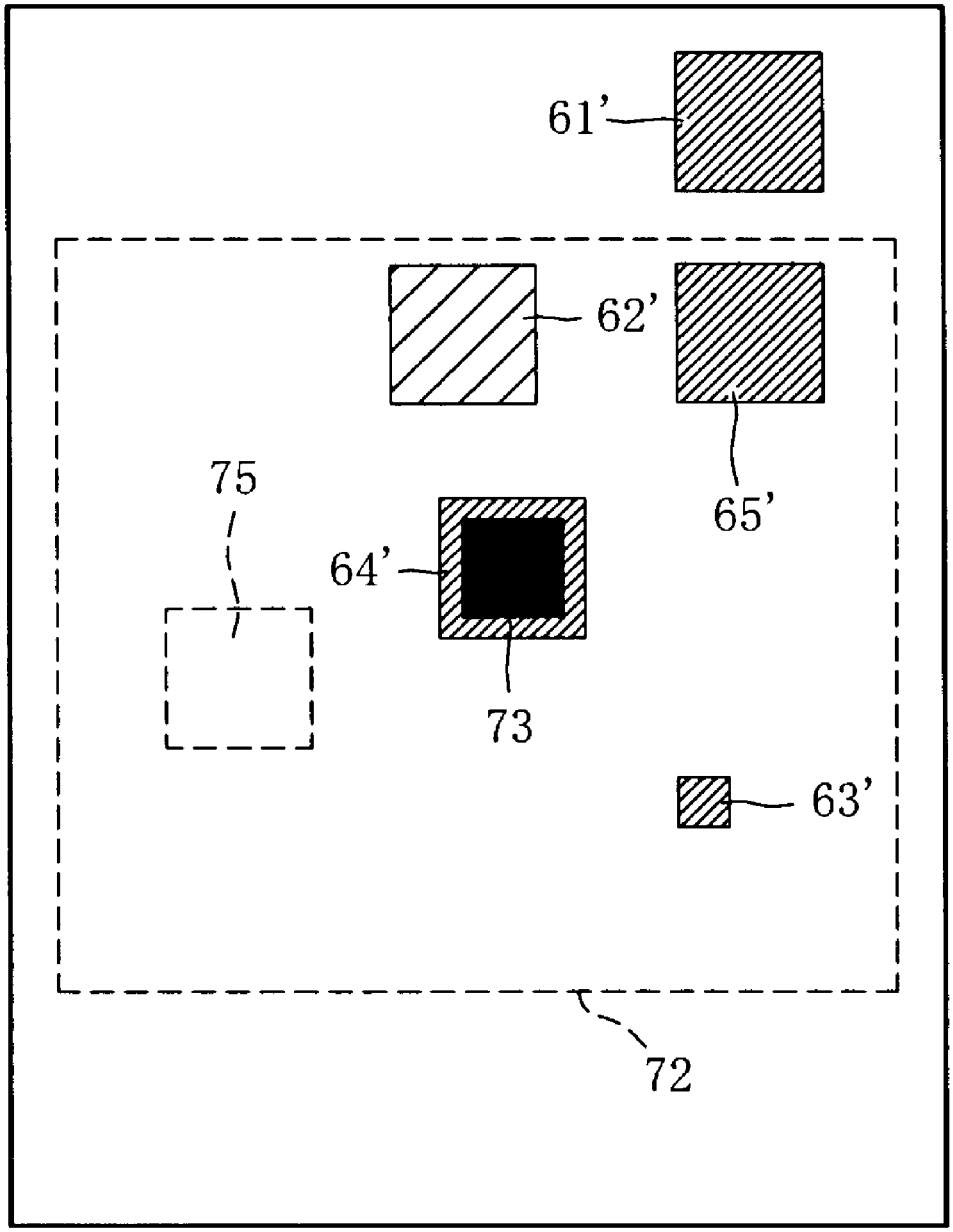
FIG. 4B is another diagram depicting measurement targets for which the OD values are measured according to an embodiment of the present invention.

Referring to FIG. 4A, a print sheet may have colored areas 61 to 65 printed on the front face thereof. Referring to FIG. 4B, the print sheet shown in FIG. 4A is reversed and colored areas 61' to 65' may be the colored areas 61 to 65 printed on the front face, which are seen through the rear face of the print sheet.

The CPU 88, e.g., measurement control unit, may identify a colored area satisfying the first to third conditions described below, among the colored areas 61 to 65 printed on the front face of the print sheet, as a front-face measurement area and may measure the OD value of the front-face measurement area. The CPU 88 then may print a colored area 73 on the rear face. If the area on the rear face corresponding to the front-face measurement area that has been identified satisfies the fourth condition described below, the CPU 88 may identify the area on the rear face corresponding to the front-face measurement area as a rear-face measurement area and may measure the OD value of the rear-face measurement area. The first condition may be that the area is printed in a central area of the print sheet, the second condition may be that the area has a density measureable by the density measurer 50, the third condition may be that the area has a size measurable by the density measurer 50, and the fourth condition may be that no colored area exists in the area on the rear face corresponding to the front-face measurement area. The colored area satisfying at least one of the first, second, and third conditions may be identified as the front-face measurement area.

Because the colored area 61 shown in FIG. 4A does not satisfy the first condition that the area is printed in a central area of the print sheet, the colored area 61 may not be identified as the front-face measurement area. In the present embodiment, a quadrangular central area 72, e.g., an area denoted by a broken line, having a longitudinal length L and a horizontal width W shown in FIG. 4A may be set as the central area on the print sheet. Because the colored area 61 is printed outside the central area 72, the colored area 61 may not satisfy the first condition.

The longitudinal length L of the central area 72 may be a length of the print sheet in the conveying direction and may be set to a value less than the distance between the pair of the first roller 45 and the second roller 46 and the pair of the third roller 47 and the fourth roller 48, as shown in FIG. 2. The horizontal width W of the central area 72 may be a length of the print sheet in a direction orthogonal to the conveying direction and may be set to a value less than a maximum measurement range between the density measurer 50 and the measurement plate 51. Thus, the colored area identified as the front-face measurement area may be within the measurement range of the density measurer 50.

Because the colored area 62 shown in FIG. 4A does not satisfy the second condition that the area has a density measurable by the density measurer 50 and because the colored area 63 shown in FIG. 4A does not satisfy the third condition that the area has a size measurable by the density measurer 50, the colored area 62 and the colored area 63 may not be identified as the front-face measurement area. The colored area having a density less than the densities measurable by the density measurer 50 or the colored area having a size less than the size measurable by the density measurer 50 may not be identified as the measurement area.

Because the colored area 64 and the colored area 65 shown in FIG. 4A each satisfy the first to third conditions, the colored area 64 and the colored area 65 are identified as the front-face measurement areas and the OD values of the colored area 64 and the colored area 65 may be measured. Nevertheless, as shown in FIG. 4B, because the colored area 73 is printed over the area 64' on the rear face corresponding to the colored area 64 on the front face by rear face printing, the area 64' on the rear face corresponding to the colored area 64 on the front face may not satisfy the fourth condition that no colored area exists in the area on the rear face corresponding to the front-face measurement area. Accordingly, the area 64' on the rear face corresponding to the colored area 64 on the front face may not be identified as the rear-face measurement area. In contrast, as shown in FIG. 4B, because the area 65' on the rear face corresponding to the colored area 65 on the front face satisfies the fourth condition, the area 65' on the rear face corresponding to the colored area 65 on the front face may be identified as the rear-face measurement area and the OD value of the area 65' may be measured.

In addition, the CPU 88 may identify an area satisfying the following three conditions, in a non-colored area having no colored area formed on its rear face, as a white background area and may measure the OD value of the white background area. The first condition may be that the area is in a central area of the print sheet, the second condition may be that the area is a white background having a measurable size, and the third condition may be that no colored area exists on the opposite side, e.g., the front face. The CPU 88 may identify a white background area 75 shown in FIG. 4B as the white background area and may measure the OD value of the white background area 75. As described above, by measuring the OD value of the white background area 75, the state of the background of the print sheet reflected in the measurement result of the rear-face measurement area may be measured from the rear face.

Nevertheless, as for the second condition that the area is a white background having a measurable size of the white background area, when the entire rear face is colored, e.g., printed, by the rear face printing, the CPU 88 may temporarily identify an area satisfying the following two conditions, in the non-colored area having no colored area formed on its front face, as a temporary white background area and may measure the OD value of the temporary white background area. The first condition may be that the area is in a central area of the print sheet, and the second condition may be that the area is a white background having a measurable size. The CPU 88 may identify a temporary white background area 76 shown in FIG. 4A as the temporary white background area and may measure the OD value of the temporary white background area 76. Accordingly, the measurement result of the temporary white background area 76, instead of the measurement result of the white background area 75, may be used, even when the white background area 75 is not identified due to the rear face printing.

Printing Process

Referring to FIG. 5, the printing process may be performed by the CPU 88 in the multifunction machine 10 upon reception of a print instruction. The print instruction may include image data indicating an image to be printed, an instruction of the number of copies, an instruction indicating whether the single-sided printing or the duplex printing is performed, the type of print sheets, the specification of a tray, and the resolution, in addition to an instruction to perform printing.

Figure 6A:
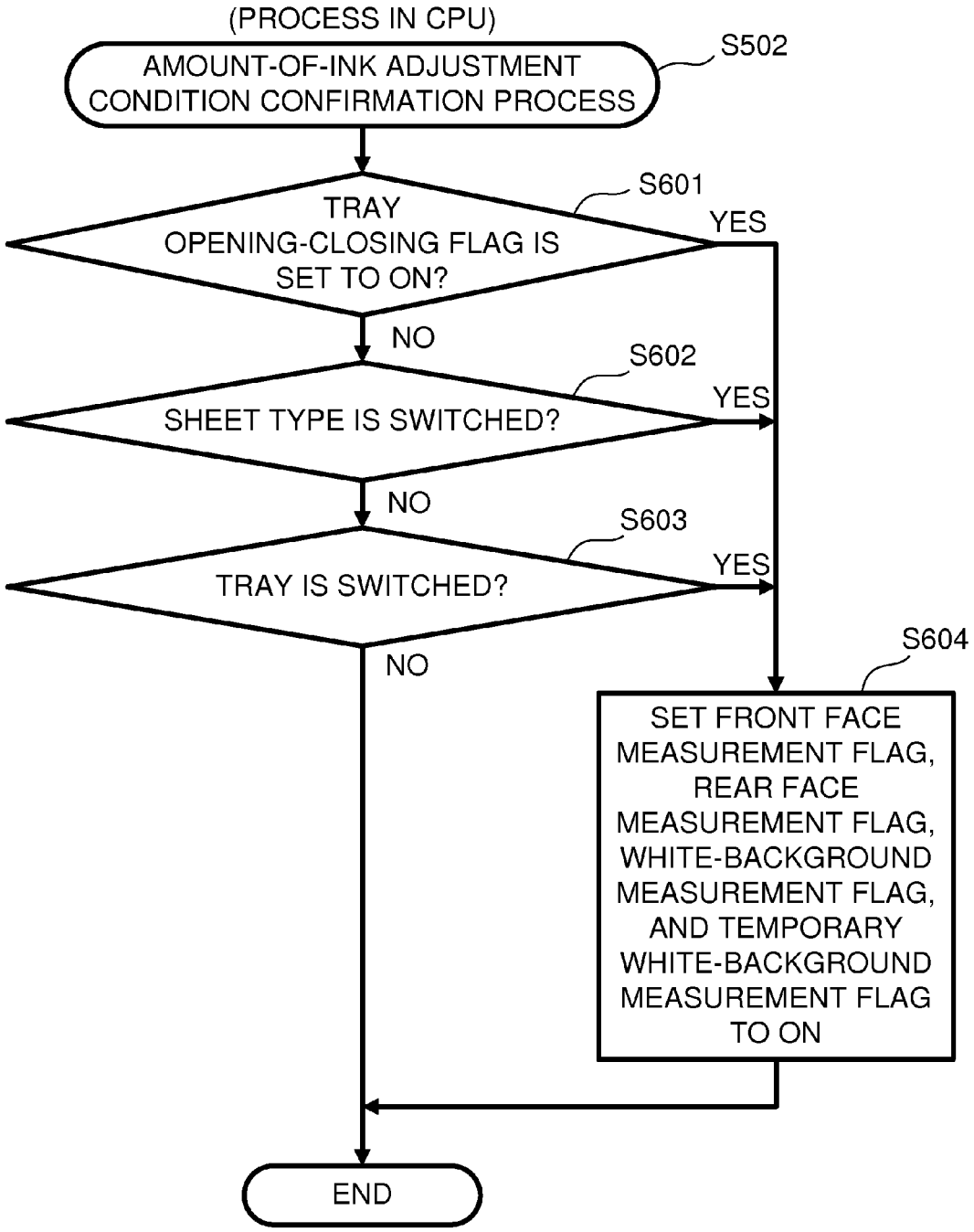
FIG. 6A is a flow chart depicting an amount-of-ink adjustment condition confirmation process according to an embodiment of the present invention.

In step S501, the CPU 88 may acquire the amount-of-ink adjustment value stored in the amount-of-ink adjustment value memory 91*a*. The amount of ink for printing may be adjusted in accordance with the amount-of-ink adjustment value. The amount-of-ink adjustment value set based on the OD value measured in the current printing may be reflected in subsequent printing. In step S502, the CPU 88 may confirm whether the amount of ink for printing is to be adjusted in an amount-of-ink adjustment condition confirmation process, as shown in FIG. 6A. If it is appropriate to adjust the amount of ink, the CPU 88 may set the various flags, such that the measurement of the OD value may be performed in order to calculate the amount of ink to be adjusted.

Figure 6B:
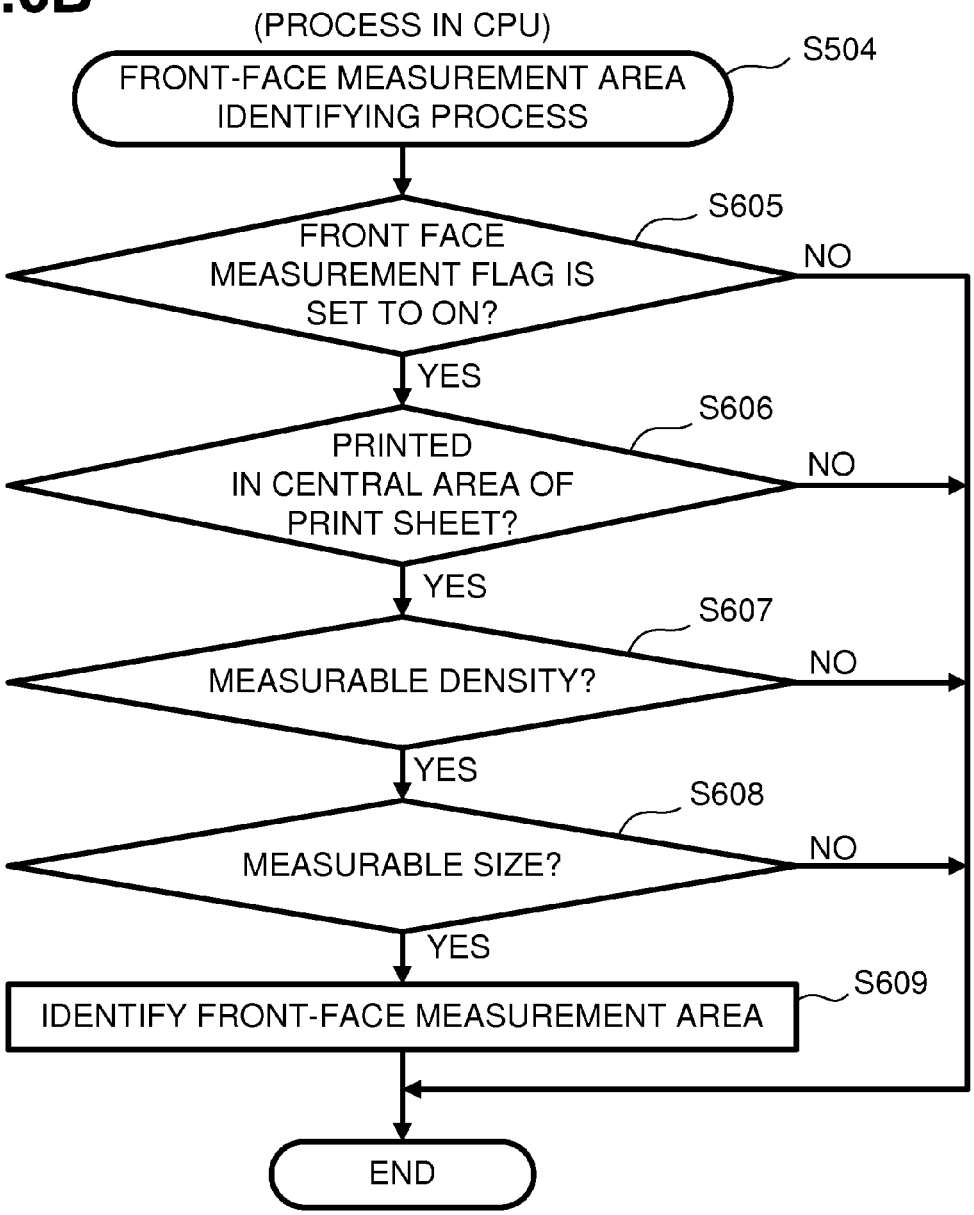
FIG. 6B is a flow chart depicting a front-face measurement area identifying process according to an embodiment of the present invention.
Figure 6C:
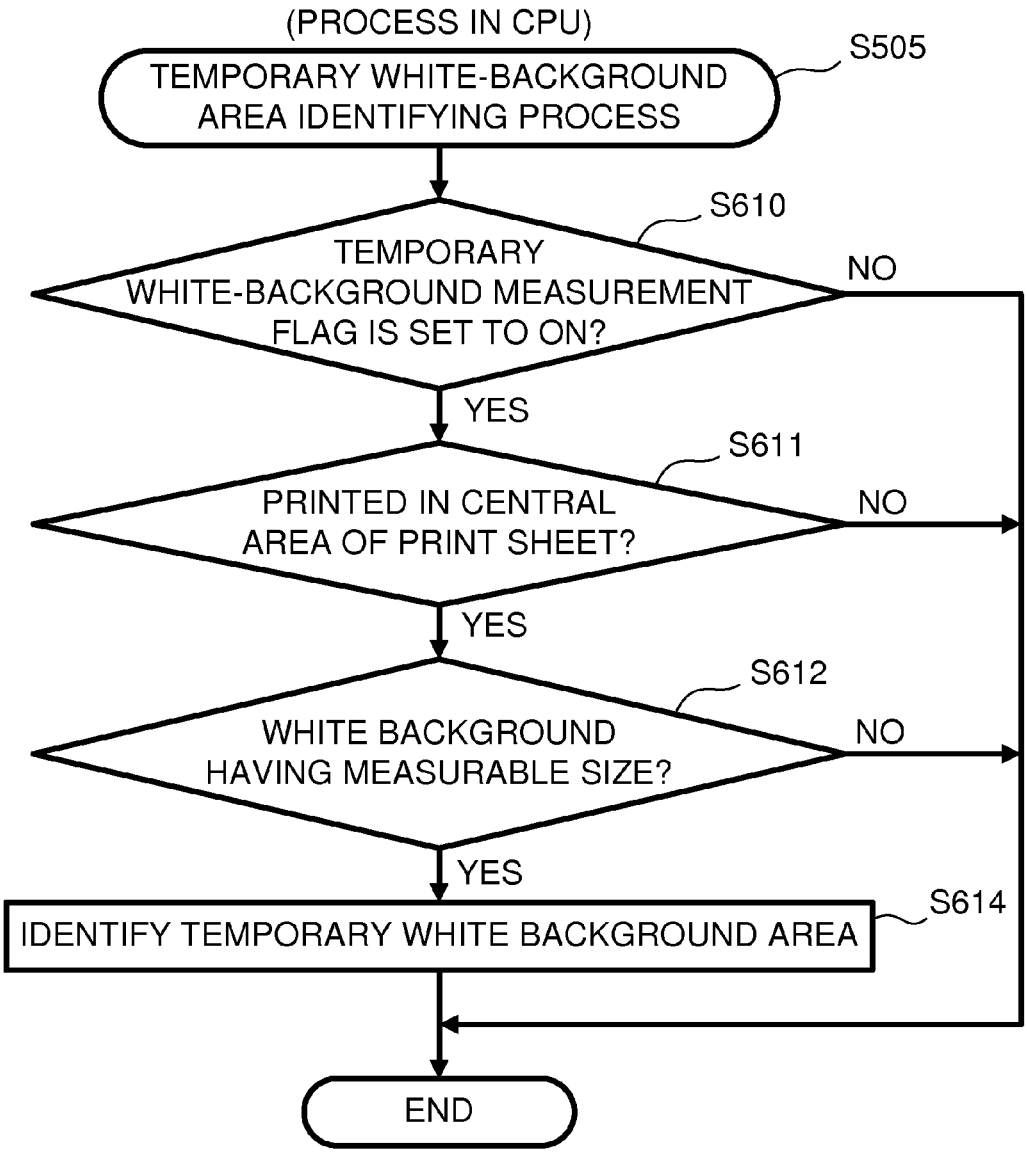
FIG. 6C is a flow chart depicting a temporary white-background area identifying process according to an embodiment of the present invention.
Figure 8A:
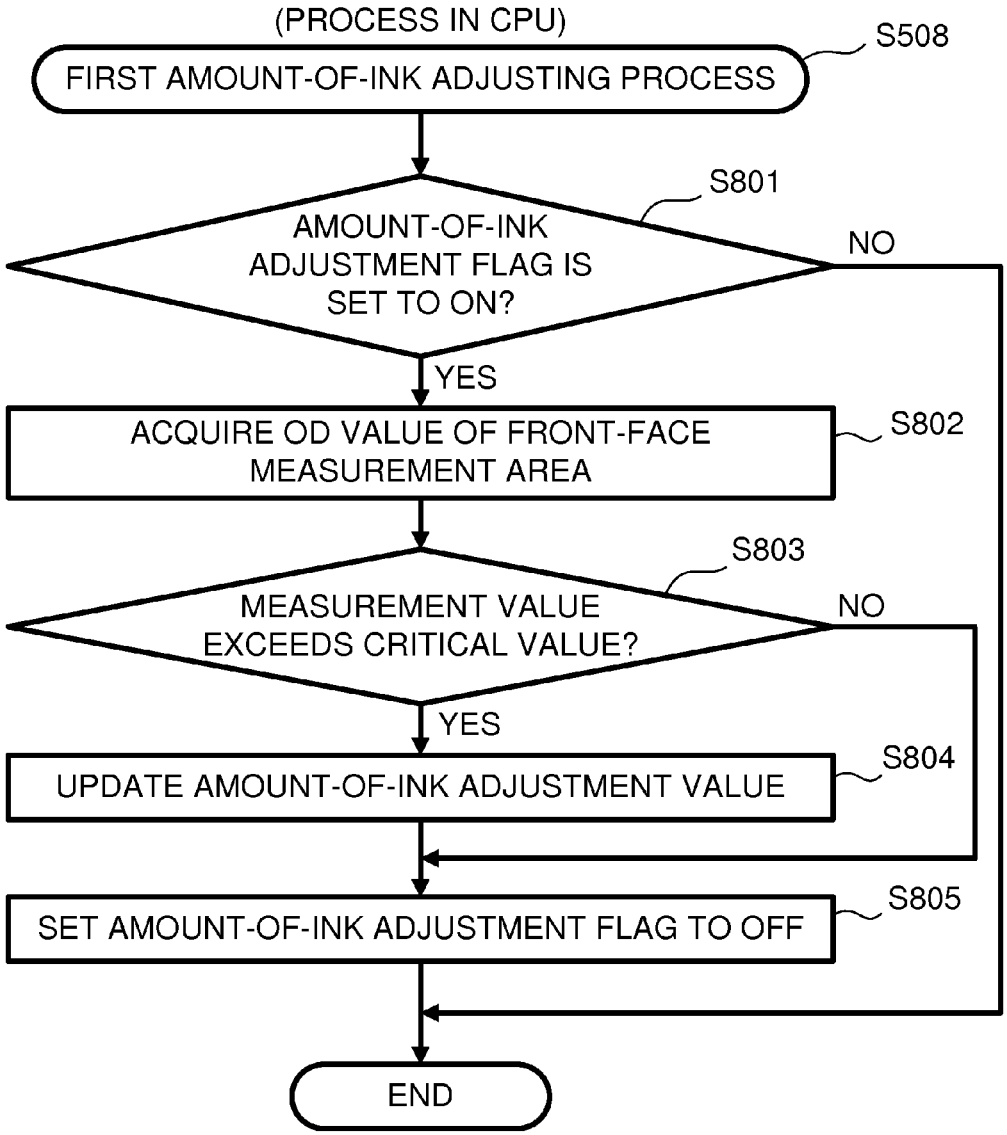
FIG. 8A is a flow chart depicting a first amount-of-ink adjusting process according to an embodiment of the present invention.

In step S503, the CPU 88 may acquire a print image to be printed on the front face of a print sheet, which may be indicated by the image data included in the print instruction. In step S504, the CPU 88 may identify the front-face measurement area, at which the OD value is measured in the front face, from among the colored areas of the acquired print image in a front-face measurement area identifying process, as shown in FIG. 6B. In step S505, the CPU 88 may identify the temporary white background area, at which the OD value is measured, from the non-colored area of the front face that is not colored in a temporary white-background area identifying process, as shown in FIG. 6C. In step S506, the CPU 88, e.g., a conveyance control unit, may feed the print sheet by controlling the feed roller 25. In step S507, the CPU 88 may perform the printing on the front face in a front face printing process, as shown in FIG. 7 and may measure the OD values of the front-face measurement area identified in step S504 and the temporary white background area identified in step S505. In step S508, the CPU 88, e.g., correction value calculating unit, may set the amount of ink to be adjusted based on the measurement result in a first amount-of-ink adjusting process, as shown in FIG. 8A.

Figure 8B:
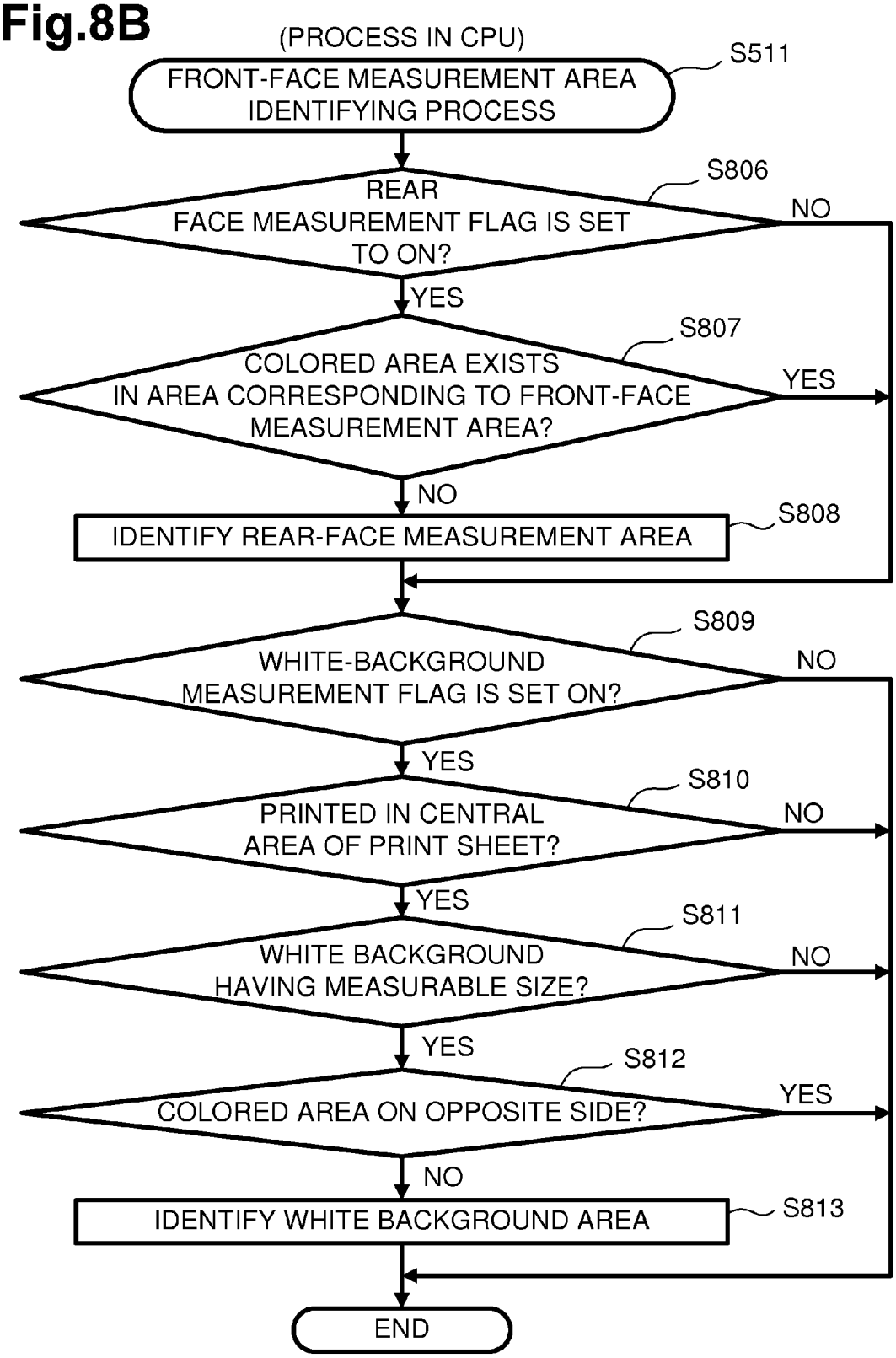
FIG. 8B is a flow chart depicting a rear-face measurement area identifying process according to an embodiment of the present invention.

In step S509, the CPU 88, e.g., a duplex printing determining unit, may determine whether the instructed printing is the duplex or single-sided printing mode based on the print instruction. If the instructed printing is not the duplex printing, e.g., NO in step S509, the CPU 88 may discharge the print sheet in step S515. The printing process then may terminate. Accordingly, in the single-sided printing mode, the amount of ink to be adjusted may be updated to the amount-of-ink adjustment value set in step S508. If the instructed printing is the duplex printing, e.g., YES in step S509, the CPU 88 may acquire a print image to be printed on the rear face of the print sheet in step S510, which is indicated by the image data included in the print instruction. In step S511, the CPU 88 may identify the rear-face measurement area, at which the OD value is measured, from the rear face in a rear-face measurement area identifying process, as shown in FIG. 8B.

Figure 9:
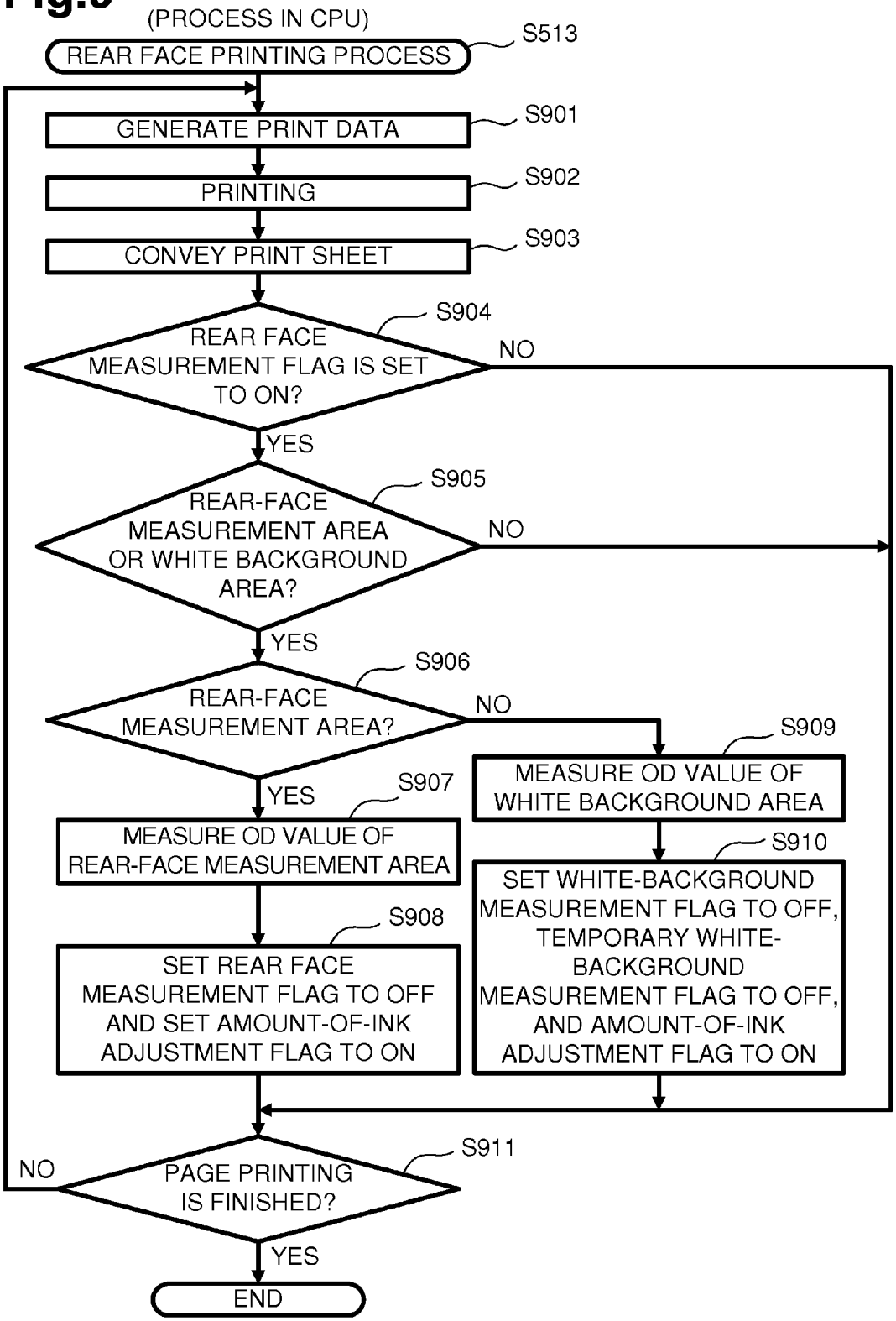
FIG. 9 is a flow chart depicting a rear face printing process according to an embodiment of the present invention.
Figure 10:
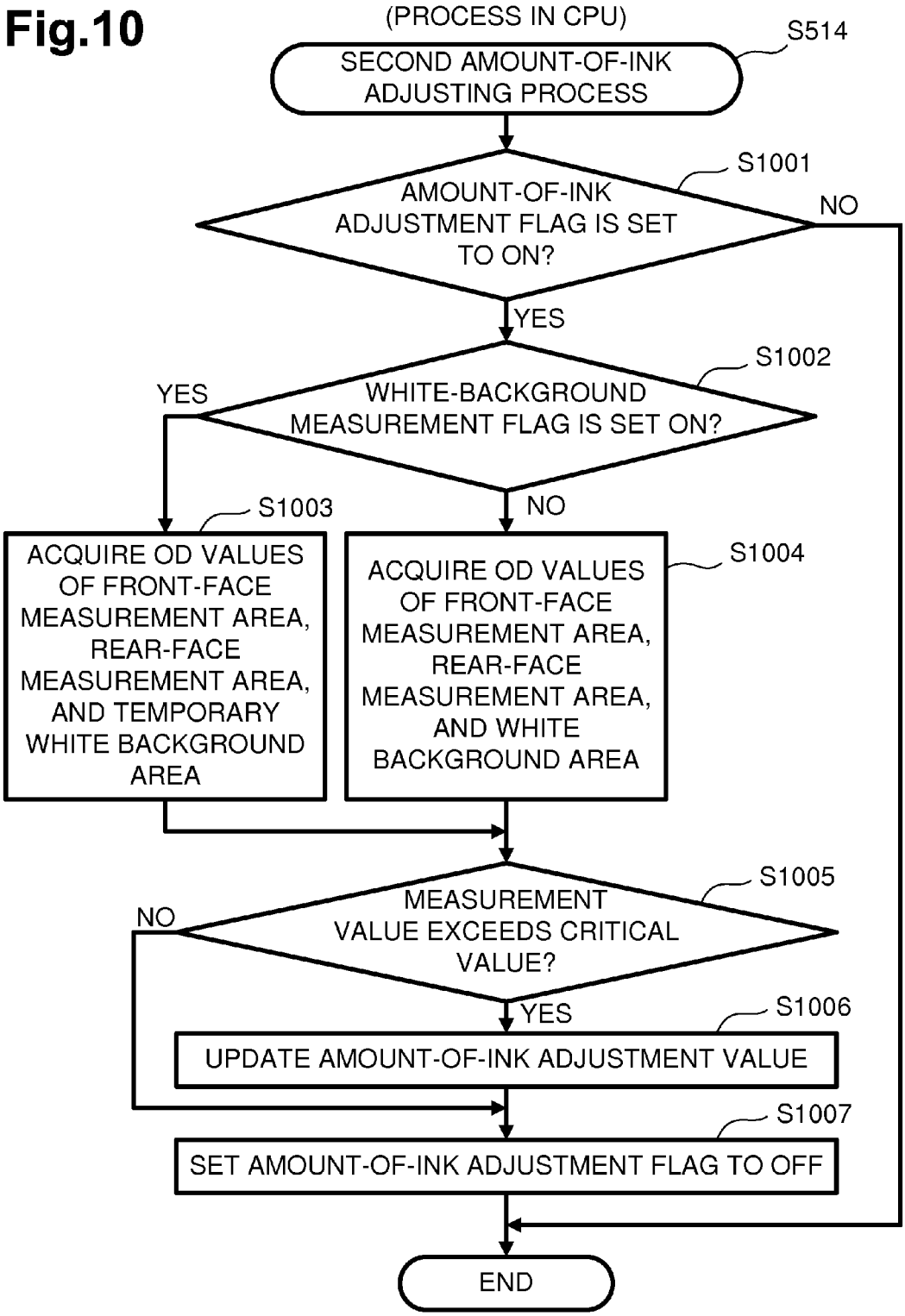
FIG. 10 is a flow chart depicting a second amount-of-ink adjusting process according to an embodiment of the present invention.

In step S512, the CPU 88 may control the feed roller 25 to reverse the print sheet and feed the print sheet forward again. In step S513, the CPU 88 may perform the printing on the rear face in a rear face printing process, as shown in FIG. 9 and may measure the OD value of the rear-face measurement area identified in step S511. In step S514, the CPU 88 may set the amount of ink to be adjusted from the measurement results in a second amount-of-ink adjusting process, as shown in FIG. 10. In step S515, the CPU 88 may discharge the print sheet. The printing process then may terminate. Accordingly, in the duplex printing mode, the amount of ink to be adjusted may be updated to the amount-of-ink adjustment value set in step S514.

Referring to FIG. 6A, the amount-of-ink adjustment condition confirmation process may confirm whether it is appropriate to adjust the amount of ink. If it is appropriate to adjust the amount of ink, the amount-of-ink adjustment condition confirmation process may set the various flags, such that the measurement of the OD value may be performed in order to calculate the amount of ink to be adjusted. The CPU 88, e.g., a type determining unit, may confirm whether the tray opening-closing flag 91*b* is set to ON in step S601, whether the sheet type is switched in step S602, and whether the tray is switched in step S603, as the conditions to adjust the amount of ink. Whether the sheet type is switched may be determined based on whether the sheet type instructed in the current printing is switched from the sheet type stored in the sheet type memory 91*c*. Whether the tray is switched may be determined based on whether the tray instructed in the current printing is switched from the tray stored in the tray switching memory 91*d*.

If the tray opening-closing flag 91*b* is set to ON, e.g., YES in step S601, the sheet type is switched, e.g., YES in step S602, or the tray is switched, e.g., YES in step S603, the CPU 88 may set all of the front face measurement flag 90*a*, the rear face measurement flag 90*b*, the temporary white-background measurement flag 90*c*, and the white-background measurement flag 90*d* to ON in step S604. The amount-of-ink adjustment condition confirmation process may then terminate. Because the adhesion state of the ink on the print sheet, e.g., the state of the ink adhering to the print sheet, is changed and because the amount of ink to be adjusted is also changed when the sheet type is switched, the CPU 88 may set the various flags, such that the measurement of the OD value may be performed in order to calculate the amount of ink to be adjusted.

If the tray opening-closing flag 91*b* is set to OFF, e.g., NO in step S601, the sheet type is not switched, e.g., NO in step S602, and the tray is not switched, e.g., NO in step S603, the amount-of-ink adjustment condition confirmation process may terminate. Because the sheet type is not switched from that in the previous printing, it may not be appropriate to adjust the amount of ink. Accordingly, because the CPU 88 may set the various flags, such that the measurement of the OD value is not performed, the instructed printing may not be delayed due to the unnecessary measurement of the OD value.

Referring to FIG. 6B, the front-face measurement area identifying process may identify the front-face measurement area, at which the OD value may be measured, from the colored areas of the print image printed on the front face. In step S605, the CPU 88 may determine whether the front face measurement flag 90*a* is set to ON. If the front face measurement flag 90*a* is set to OFF, e.g., NO in step S605, the front-face measurement area identifying process may terminate, because it may not be appropriate to measure the OD value. If the front face measurement flag 90*a* is set to ON, e.g., YES in step S605, the CPU 88 may identify the colored area satisfying three conditions: (1) the area is printed in a central area of the print sheet, e.g., YES in step S606, (2) the area has a measurable density, e.g., YES in step S607, and (3) the area has a measurable size, e.g., YES in step S608, from among the colored areas formed on the front face, as the front-face measurement area. The front-face measurement area identifying process may then terminate. The position of the identified front-face measurement area may be stored in the measurement area memory 90*g*. The CPU 88 may not identify the colored area that is printed outside a central area of the print sheet, e.g., NO in step S606, that has a density less than the measurable density, e.g., NO in step S607, or that has a size less than the measurable size, e.g., NO in step S608, from among the colored areas formed on the front face, as the front-face measurement area. The front-face measurement area identifying process then may terminate.

Referring to FIG. 6C, the temporary white-background area identifying process may identify the temporary white background area, at which the OD value is measured, from the non-colored area of the print image printed on the front face. In step S610, the CPU 88 may determine whether the temporary white-background measurement flag 90*c* is set to ON. If the temporary white-background measurement flag 90*c* is set to OFF, e.g., NO in step S610, the temporary white-background area identifying process may terminate, because it may not be appropriate to measure the OD value. If the temporary white-background measurement flag 90*c* is set to ON, e.g., YES in step S610, the CPU 88 may identify the non-colored area that is: (1) printed in a central area of the print sheet, e.g., YES in step S611, and (2) a white background having a measurable size, e.g., YES in step S612, from the non-colored area formed on the front face, as the temporary white background area. The temporary white-background area identifying process may then terminate. The position of the identified temporary white background area may be stored in the measurement area memory 90*g*. The CPU 88 may not identify the non-colored area that is printed outside of the central area of the print sheet, e.g., NO in step S611, or that has a size less than the measurable size, e.g., NO in step S612, as the temporary white background area. The temporary white-background area identifying process may then terminate.

Referring to FIG. 7, the front face printing process may perform printing on the front face and may measure the OD values of the front-face measurement area identified in step S609 in FIG. 6B and the temporary white background area identified in step S614 in FIG. 6C. In step S701, the CPU 88 may generate print data from the print image on the front face acquired in step S503 in FIG. 5. In step S702, the CPU 88 may perform the printing in accordance with the print data by a unit line corresponding to the length in the conveying direction of the print head 39. In step S703, the CPU 88 may convey the print sheet by steps of the unit line.

In step S704, the CPU 88 may determine whether the temporary white-background measurement flag 90*c* is set to ON. In step S705, the CPU 88 may determine whether duplex or single-sided printing is to be performed. In step S706, the CPU 88 may determine whether the current position to which the print sheet is conveyed is the temporary white background area. If the CPU 88 determines that the temporary white-background measurement flag 90*c* is set to ON, e.g., YES in step S704, that duplex printing is to be performed, e.g., YES in step S705, and that the current position to which the print sheet is conveyed is the temporary white background area, e.g., YES in step S706, the CPU 88 may measure the OD value of the temporary white background area and may set the temporary white-background measurement flag 90*c* to OFF in step S707. The process then may proceed to step S708. If the CPU 88 determines that the temporary white-background measurement flag 90*c* is set to OFF, e.g., NO in step S704, that duplex printing is not to be performed, e.g., NO in step S705, or that the current position to which the print sheet is conveyed is not the temporary white background area, e.g., NO in step S706, the process may skip step S707 and may proceed to step S708.

In step S708, the CPU 88 may determine whether the front face measurement flag 90*a* is set to ON. In step S709, the CPU 88 may determine whether the current position to which the print sheet is conveyed is the front-face measurement area. If the front face measurement flag 90*a* is set to ON, e.g., YES in step S708 and the current position to which the print sheet is conveyed is the front-face measurement area, e.g., YES in step S709, the CPU 88 may stop the conveyance of the print sheet and may enter a waiting mode for a certain time in step S710 before the measurement of the front-face measurement area is started. In step S711, the CPU 88 may measure the OD value of the front-face measurement area after the certain time. In step S712, the CPU 88 may set the front face measurement flag 90*a* to OFF and the amount-of-ink adjustment flag 90*e* to ON. The process then may proceed to step S713. The OD value measured in S711 may be stored in the OD value memory 90*f*. Because the OD value of the front-face measurement area is measured in step S711 after the certain time has elapsed in step S710, the ink on the front-face measurement area may sufficiently stick onto the print sheet and, thus, the OD value may be accurately measured.

The front-face measurement area to be measured may be the area identified in step S609 in FIG. 6B from the colored areas of the print image acquired in step S503 in FIG. 5. Because the front-face measurement area satisfying a certain condition is identified from the print image and the OD value of the front-face measurement area is measured, it may not be appropriate to perform test printing to perform measurement of a test pattern that is prepared in advance. Accordingly, the OD value may be measured without wasting the print sheet and the ink.

If the front face measurement flag 90*a* is set to OFF, e.g., NO in step S708 or the current position to which the print sheet is conveyed is not the front-face measurement area, e.g., NO in step S709, the process may skip steps S710 to 5712 and may proceed to step S713. In step S713, the CPU 88 may determine whether the image indicated by the image data is printed on the front face of the print sheet, e.g., whether the page printing on the front face is finished. If the page printing on the front face is not finished, e.g., NO in step S713, the process may return to step S701. If the page printing on the front face is finished, e.g., YES in step S713, the front face printing process may terminate.

Referring to FIG. 8A, the first amount-of-ink adjusting process may set the amount of ink to be adjusted based on the OD value of the front-face measurement area measured in step S711 in FIG. 7. In step S801, the CPU 88 may determine whether the amount-of-ink adjustment flag 90*e* is set to ON. If the amount-of-ink adjustment flag 90*e* is set to ON, e.g., YES in step S801, the CPU 88 may acquire the OD value of the front-face measurement area from the OD value memory 90*f* in step S802. In step S803, the CPU 88 may determine whether the acquired OD value exceeds a predetermined critical value. If the acquired OD value exceeds the predetermined critical value, e.g., YES in step S803, the CPU 88, e.g., correcting unit, may correct and update the amount-of-ink adjustment value stored in the amount-of-ink adjustment value memory 91*a* in step S804. In step S805, the CPU 88 may set the amount-of-ink adjustment flag 90*e* to OFF. The first amount-of-ink adjusting process then may terminate. For example, the amount-of-ink adjustment value may be corrected and updated, so that the amount of ink is decreased by an amount corresponding to the difference between the OD value of the front-face measurement area and the critical value. The difference between the OD value of the front-face measurement area and the OD value of the temporary white background area measured in step S707 in FIG. 7 may be used as the measurement result, and the measurement result may be compared with the critical value to correct and update the amount-of-ink adjustment value.

If the CPU 88 determines that the amount-of-ink adjustment flag 90*e* is not set to ON, e.g., NO in step S801, the first amount-of-ink adjusting process may terminate, and the amount-of-ink adjustment value may not be corrected and updated. The processing load on the correction may be reduced with the above steps, compared with when the amount-of-ink adjustment value is linearly corrected and updated in accordance with the measurement result. If the CPU 88 determines that the acquired OD value does not exceed the critical value, e.g., NO in step S803, the CPU 88 may not update the amount-of-ink adjustment value, and, in step S805, the CPU 88 may set the amount-of-ink adjustment flag 90*e* to OFF. The first amount-of-ink adjusting process then may terminate.

Referring to FIG. 8B, the rear-face measurement area identifying process may identify the rear-face measurement area, at which the OD value is measured, from the rear face and the white background area, at which the OD value is measured, from the rear face. In step S806, the CPU 88 may determine whether the rear face measurement flag 90*b* is set to ON. If the rear face measurement flag 90*b* is set to OFF, e.g., NO in step S806, the process may skip steps S807 and 5808 and may proceed to step S809, because there may be no need to measure the OD value. If the rear face measurement flag 90*b* is set to ON, e.g., YES in step S806, the CPU 88 may determine whether any colored area exists in the area corresponding to the front-face measurement area in step S807. If no colored area exists in the area corresponding to the front-face measurement area, e.g., NO in step S807, the CPU 88 may identify the area corresponding to the front-face measurement area as the rear-face measurement area in step S808. The process then may proceed to step S809. The CPU 88 may store the position of the identified rear-face measurement area in the measurement area memory 90*g*. If any colored area exists in the area corresponding to the front-face measurement area, e.g., YES in step S807, the process may skip step S808 and may proceed to step S809.

In step S809, the CPU 88 may determine whether the white-background measurement flag 90*d* is set to ON. If the white-background measurement flag 90*d* is set to OFF, e.g., NO in step S809, the process may skip steps S810 to S813, because there may be no need to measure the OD value, and the rear-face measurement area identifying process may terminate. If the white-background measurement flag 90*d* is set to ON, e.g., YES in step S809, the CPU 88 may identify the non-colored area that is printed in a central area of the print sheet, e.g., YES in step S810, that is a white background having a measurable size, e.g., YES in step S811, and that does not have the colored area on the opposite side (the front face), e.g., NO in step S812, in the non-colored area formed on the rear face, as the white background area, in step S813. The rear-face measurement area identifying process then may terminate. The CPU 88 may store the position of the identified white background area in the measurement area memory 90*g*. The CPU 88 may not identify the non-colored area that is not printed in a central area of the print sheet, e.g., NO in step S810, that is not a white background having a measurable size, e.g., NO in step S811, or that has the colored area on the opposite side, e.g., YES in step S812, in the non-colored area formed on the rear face, as the white background area. The rear-face measurement area identifying process then may terminate.

Referring to FIG. 9, the rear face printing process may perform the printing on the rear face and may measure the OD values of the rear-face measurement area identified in step S808 in FIG. 8B and the white background area identified in step S813 in FIG. 8B. In step S901, the CPU 88 may generate print data from the print image on the rear face of the print sheet, indicated by the image data included in the print instruction. In step S902, the CPU 88 may perform the printing in accordance with the print data by a unit line corresponding to the length in the conveying direction of the print head 39. In step S903, the CPU 88 may convey the print sheet by the unit line. In step S904, the CPU 88 may determine whether the rear face measurement flag 90*b* is set to ON. In step S905, the CPU 88 may determine whether the current position to which the print sheet is conveyed is the rear-face measurement area or the white background area. In step S906, the CPU 88 may determine whether the current position to which the print sheet is conveyed is the rear-face measurement area.

If the CPU 88 determines that the rear face measurement flag 90*b* is set to ON, e.g., YES in step S904, that the current position to which the print sheet is conveyed is the rear-face measurement area or the white background area, e.g., YES in step S905, and that the current position to which the print sheet is conveyed is the rear-face measurement area, e.g., YES in step S906, the CPU 88 may measure the OD value of the rear-face measurement area in step S907. In step S908, the CPU 88 may set the rear face measurement flag 90*b* to OFF and may set the amount-of-ink adjustment flag 90*e* to ON. The process then may proceed to step S911. The CPU 88 may store the OD value of the rear-face measurement area measured in step S907 in the OD value memory 90*f*. In the measurement of the OD value of the rear-face measurement area in step S907, the certain time elapses in step S710 in FIG. 7, and the print sheet that is reversed may be fed in step S512 in FIG. 5. Because the ink sufficiently sticks onto the print sheet, the OD value may be accurately measured.

The rear-face measurement area to be measured may have been identified in step S808 in FIG. 8B. Because the rear-face measurement area satisfying a certain condition is identified from the print image and the OD value of the rear-face measurement area is measured, there may be no need to perform the test printing for the measurement of a test pattern that is prepared in advance. Accordingly, the OD value may be measured without wasting the print sheet or the ink.

If the CPU 88 determines that the rear face measurement flag 90*b* is set to ON, e.g., YES in step S904 and the current position to which the print sheet is conveyed is the rear-face measurement area or the white background area, e.g., YES in step S905, but the current position to which the print sheet is conveyed is not the rear-face measurement area, e.g., NO in step S906, the CPU 88 may measure the OD value of the white background area in step S909. In step S910, the CPU 88 may set the white-background measurement flag 90*d* and the temporary white-background measurement flag 90*c* to OFF and may set the amount-of-ink adjustment flag 90*e* to ON. The process then may proceed to step S911. The OD value of the white background area measured in step S909 may be stored in the OD value memory 90*f*. If the CPU 88 determines that the rear face measurement flag 90*b* is not set to ON, e.g., NO in step S904, or the current position to which the print sheet is conveyed is not the rear-face measurement area or the white background area, e.g., NO in step S905, the process may proceed to step S911. In step S911, the CPU 88 may determine whether the image indicated by the image data is printed on the rear face of the print sheet, e.g., whether the page printing on the rear face is finished. If the page printing on the rear face is not finished, e.g., NO in step S911, the process may go back to step S901. If the page printing on the rear face is finished, e.g., YES in step S911, the rear face printing process may terminate.

Referring to FIG. 10, the second amount-of-ink adjusting process may set the amount of ink to be adjusted from the measurement results, e.g., the OD value, that has been measured. In step S1001, the CPU 88 may determine whether the amount-of-ink adjustment flag 90*e* is set to ON. If the CPU 88 determines that the amount-of-ink adjustment flag 90*e* is set to OFF, e.g., NO in step S1001, the second amount-of-ink adjusting process may terminate. If the CPU 88 determines that the amount-of-ink adjustment flag 90*e* is set to ON, e.g., YES in step S1001, the CPU 88 may determine whether the white-background measurement flag 90*d* is set to ON in step S1002. If the white-background measurement flag 90*d* is set to OFF, e.g., the white background measurement has been performed, e.g., NO in step S1002, the CPU 88, e.g., calculating unit, may acquire the OD values of the front-face measurement area, the rear-face measurement area, and the white background area stored in the OD value memory 90*f* as the measurement values to calculate the measurement value from each OD value in step S1004. The process then may proceed to step S1005.

For example, the difference between the OD value of the rear-face measurement area and the OD value of the white background area may be used as a first see-through value, the difference between the OD value of the front-face measurement area and the OD value of the white background area may be used as a second see-through value, and the average of the first see-through value and the second see-through value may be calculated as the measurement result. The measurement result incorporating the OD value of the front-face measurement area, the OD value of the rear-face measurement area, and the OD value of the white background area may be acquired in the above manner. The OD value of the rear-face measurement area may be used as the measurement result or the difference between the OD value of the rear-face measurement area and the OD value of the white background area may be used as the measurement result.

If the white-background measurement flag 90*d* is set to ON, e.g., the white background measurement has not been performed, e.g., YES in step S1002, the CPU 88 may acquire the OD values of the front-face measurement area, the rear-face measurement area, and the temporary white background area stored in the OD value memory 90*f* as the measurement values to calculate the measurement value from each OD value in step S1003. The process then may proceed to step S1005. Even if the white background measurement is not performed due to the rear face printing, the OD value of the temporary white background area may be used, instead of the OD value of the white background area, to acquire the measurement result in the same level as that of the measurement result calculated in step S1004.

In step S1005, the CPU 88, e.g., a critical value determining unit, may determine whether the measurement value acquired in step S1003 or step S1004 exceeds a critical value. If the CPU 88 determines that the measurement value acquired in step S1003 or step S1004 exceeds the critical value, e.g., YES in step S1005, the CPU 88 may correct and update the amount-of-ink adjustment value stored in the amount-of-ink adjustment value memory 91*a* in step S1006. In step S1007, the CPU 88 may set the amount-of-ink adjustment flag 90*e* to OFF. The second amount-of-ink adjusting process then may terminate. The processing load on the correction may be reduced, compared with when the amount-of-ink adjustment value is linearly corrected and updated in accordance with the measurement result. The amount-of-ink adjustment value may be corrected and updated, for example, so that the amount of ink may be decreased in accordance with the difference between the OD value of the front-face measurement area and the critical value. If the CPU 88 determines that the measurement value acquired in step S1003 or step S1004 does not exceed the critical value, e.g., NO in step S1005, the CPU 88 may not update the amount-of-ink adjustment value and, in step S1007, the CPU 88 may set the amount-of-ink adjustment flag 90*e* to OFF. The second amount-of-ink adjusting process then may terminate.

Advantages of the Present Embodiment

Because the OD value may be measured after a certain time in the measurement of the colored area by the density measurer 50, the print agent may sufficiently stick onto the print sheet, thereby accurately measuring the print state of the colored area. Specifically, because the print sheet is conveyed to the reverse path 16 for the certain time in the measurement of the OD value from the rear face in the duplex printing, a time may be allotted for the print agent to sufficiently stick onto the print sheet. In addition, because the print sheet is stopped on the conveying path for the certain time in the measurement of the OD value from the front face, a time may be allotted for the print agent to sufficiently stick onto the print sheet.

Further, because the colored area formed on the print sheet is measured at a time when the sheet type of the print sheet is switched, the print state may be measured when the print state is changed due to the switching of the sheet type. When the sheet type is not switched, the print state may not be changed and the measurement may not be performed to prevent a delay in the printing. In duplex printing, the print state of each colored area formed on the front face may be measured from the rear face, such that the effect of the colored area on the opposite side may be measured.

Further, because the measurement result is calculated from the measurement result of the colored area and the measurement result of the non-colored area, the effect of the background of the print sheet, which is the measurement result of the non-colored area, may be reflected in the measurement result of the colored area.

Further, one measurement result may be acquired, in which the measurement results measured from the front face and the rear face are reflected, from the measurement results on both of the faces. Because the amount of the print agent to be added to the print sheet is corrected if the measurement result exceeds a predetermined critical value, the processing load on the correction may be reduced, compared with when the correction is linearly performed in accordance with the measurement result. Because the correction value calculated from the measurement result for one print sheet is used in the correction of print sheets other than the one print sheet, the print state of the image to be printed on the same print sheet may be maintained.

Further, because the density measurer 50 is arranged at the print face side where the printing on the print sheet is performed by a printing unit on the conveying path, the print state of the colored area formed on the front face may be measured from the rear face in the duplex printing. Thus, the effect of the colored area on the opposite face may be measured.

The amount-of-ink adjustment value may be set and updated based on the measured OD values. In anther embodiment, the type or thickness, or both, of the print sheet may be acquired from a print instruction from the user or a sheet thickness measurer to set and update the amount-of-ink adjustment value in accordance with the type or thickness, or both, of the print sheet and the measured OD values. Thus, a more appropriate amount-of-ink adjustment value may be set or updated.

The print sheet may be stopped during the measurement of the OD value. In another embodiment, the OD value may be measured while the print sheet is conveyed within a range in which the OD value may be measured. Thus, a delay in the printing due to the measurement of the OD value may be prevented.

The print sheet may be stopped at step S710 or reversed at step S512 to allow time for the colored area formed on the front face to stick onto the print sheet. In another embodiment, the conveyance speed may be decreased during a time period after the colored area is formed on the front face before the measurement is started, or the print sheet may be fed backward without reversing the print sheet after the print sheet passes the measurement point.

The measurement target may be identified from the print image that is instructed and the measurement may be performed for the identified measurement target without using a test pattern prepared in advance. In another embodiment, a test pattern prepared in advance may be measured. Thus, the processing load to identify the measurement target from the instructed print image may be reduced.

The measurement may be performed once for one measurement target. In another embodiment, the measurement may be performed multiple times for one measurement target. Performing the measurement multiple times may achieve more accurate measurement results.

The OD value may be measured if the tray opening-closing flag 91*b* is set to ON, e.g., YES in step S601, if the sheet type is switched, e.g., YES in step S602, or if the tray is switched, e.g., YES in step S603, as shown in FIG. 6A. In another embodiment, execution and non-execution of the measurement of the OD value may be switched in accordance with the print resolution. For example, the measurement of the OD value may be executed when the printing is in a standard mode or a fine mode, e.g., a mode using a resolution greater than or equal to the standard resolution, and the measurement of the OD value may not be executed when the printing is in a draft mode, e.g., a low-resolution mode.

One measurement target may be identified. In another embodiment, multiple measurement targets may be identified. One or more measurement targets may be identified for each color. When one or more measurement targets are identified for each color, an appropriate amount-of-ink adjustment value for each color may be set. Alternatively, the amount-of-ink adjustment values of other colors may be set based on the amount-of-ink adjustment value of one color.

While the invention has been described in connection with various exemplary structures and illustrative embodiments, it will be understood by those skilled in the art that other variations and modifications of the structures, configurations, and embodiments described above may be made without departing from the scope of the invention. For example, this application may comprise many possible combinations of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A printing apparatus comprising:

a printing unit configured to form an image on a predetermined surface of a print sheet by depositing a print agent on the print sheet;

a discharging unit configured to receive the print sheet;

a conveying unit configured to convey the print sheet from the printing unit to the discharging unit through a conveying path;

a measuring unit disposed along the conveying path and configured to measure a print characteristic of the image formed by the printing unit on the print sheet;

a conveyance control unit configured to control the conveying unit to perform a first conveying process, in which the conveying unit conveys the print sheet, such that a colored area of the image formed on the print sheet passes through a measurement point in the conveying path, where the measuring unit measures the print characteristic of the image, after a predetermined time has elapsed since the printing unit forms the colored area of the image on the print sheet, and a second conveying process, in which the conveying unit conveys the print sheet, such that the colored area of the image formed on the print sheet passes through the measurement point in the conveying path before the predetermined time has elapsed since the printing unit forms the colored area of the image on the print sheet, wherein the conveyance control unit is configured to control the conveying unit to perform the first conveying process when the colored area of the image is measured by the measuring unit and to control the conveying unit to perform the second conveying process when the colored area of the image is not measured by the measuring unit.

2. The printing apparatus according to claim 1, wherein the conveying unit is configured to convey the print sheet through a reverse path, which branches from the conveying path and through which the print sheet is conveyed to the printing unit in a reversed state, and wherein the conveyance control unit is configured to control the conveying unit to convey the print sheet to the reverse path after the predetermined time has elapsed in the first conveying process.

3. The printing apparatus according to claim 1, wherein the conveyance control unit is configured to control the conveying unit to stop conveying the print sheet in the conveying path for the predetermined time in the first conveying process.

4. The printing apparatus according to claim 1, further comprising:

a type determining unit configured to determine whether a type of the print sheet is different from that of a next print sheet conveyed by the conveying unit, wherein, when the type of the print sheet is different from that of the next print sheet, the conveyance control unit controls the conveying unit to convey the next print sheet in the first conveying process, such that a colored area of an image formed on the next print sheet is measured by the measuring unit.

5. The printing apparatus according to claim 1, further comprising:

a duplex printing determining unit configured to determine whether a duplex printing instruction is received, wherein, when the duplex printing instruction is received, the conveyance control unit controls the conveying unit to perform the first conveying process, such that a colored area of the image formed on an alternative surface of the print sheet, which is opposite from the predetermined surface of the print sheet, is measured by the measuring unit.

6. The printing apparatus according to claim 1, wherein the measuring unit is configured to measure a print characteristic from a non-colored area of the image where the print agent is not deposited to the print sheet by the printing unit and measure a print characteristic from a colored area of the image where the print agent is deposited to the print sheet by the printing unit, wherein the apparatus further comprises:

a calculating unit configured to calculate a value of the print characteristic of the image formed on the print sheet based on the print characteristic measured from the non-colored area and the print characteristic measured from the colored area.

7. The printing apparatus according to claim 1, wherein the measuring unit is configured to measure a first print characteristic from a colored area of the image formed on the predetermined surface of the print sheet and a second print characteristic from a colored area of the image formed on an alternative surface of the print sheet, which is opposite from the predetermined surface of the print sheet, wherein the printing apparatus further comprises:

a calculating unit configured to calculate a value of the print characteristic of the image formed on the print sheet based on the first print characteristic measured from the colored area on the predetermined surface of the print sheet and the second print characteristic from the colored area on the alternative surface of the print sheet.

8. The printing apparatus according to claim 1, further comprising:

a critical value determining unit configured to determine whether a value of the print characteristic of the image measured by the measuring unit is greater than a predetermined critical value;

a correction value calculating unit configured to calculate a correction value for correcting an amount of print agent used by the printing unit based on the value of the print characteristic of the image, when the value of the print characteristic of the image is greater than the predetermined critical value; and a correcting unit configured to correct the amount of the print agent used by the printing unit based on the correction value calculated by the correction value calculating unit.

9. The printing apparatus according to claim 8, wherein the correction value calculating unit is configured to calculate the correction value for correcting the amount of print agent used by the printing unit based on the print characteristic measured by the measuring unit from the image formed on the print sheet, and wherein the correcting unit corrects the amount of the print agent to be deposited to a next print sheet, which is different from the print sheet from which the correction value is calculated.

10. The printing apparatus according to claim 1, wherein the measuring unit is disposed at a side of the conveying path where the printing unit deposits the print agent onto the print sheet.

11. The printing apparatus according to claim 1, wherein the print characteristic comprises an optical reflection density of the image formed on the print sheet.

12. A printing apparatus comprising:

a controller configured to control the printing apparatus to execute steps of:

forming an image on a print sheet by depositing a print agent on the print sheet;

receiving the print sheet at a discharging unit;

conveying the print sheet to the discharging unit through a conveying path; and measuring a print characteristic of the image formed on the print sheet;

selectively conveying the print sheet in a first conveying process, in which the print sheet is conveyed, such that a colored area of the image formed on the print sheet passes through a measurement point in the conveying path, where the print characteristic of the image is measured, after a predetermined time has elapsed since the colored area of the image is formed on the print sheet, and in a second conveying process, in which the print sheet is conveyed, such that the colored area of the image formed on the print sheet passes through the measurement point in the conveying path before the predetermined time has elapsed since the colored area of the image is formed on the print sheet, wherein the print sheet is conveyed in the first conveying process when the print characteristic is measured from the colored area of the image and the print sheet is conveyed in the second conveying process when the print characteristic is not measured from the colored area of the image.

13. A non-transitory computer readable storage medium storing computer readable instructions that, when executed, cause a printing apparatus to execute steps of:

forming an image on a print sheet by depositing a print agent on the print sheet;

receiving the print sheet at a discharging unit;

conveying the print sheet to the discharging unit through a conveying path; and measuring a print characteristic of the image formed on the print sheet;

selectively conveying the print sheet in a first conveying process, in which the print sheet is conveyed, such that a colored area of the image formed on the print sheet passes through a measurement point in the conveying path, where the print characteristic of the image is measured, after a predetermined time has elapsed since the colored area of the image is formed on the print sheet, and in a second conveying process, in which the print sheet is conveyed, such that the colored area of the image formed on the print sheet passes through the measurement point in the conveying path before the predetermined time has elapsed since the colored area of the image is formed on the print sheet, wherein the print sheet is conveyed in the first conveying process when the print characteristic is measured from the colored area of the image and the print sheet is conveyed in the second conveying process when the print characteristic is not measured from the colored area of the image.

* * * * *